US006537397B1

(12) United States Patent
Sugawara

(10) Patent No.: US 6,537,397 B1
(45) Date of Patent: Mar. 25, 2003

(54) PROCESS FOR PRODUCING FE-BASED MEMBER HAVING HIGH YOUNG'S MODULUS, AND FE-BASED MEMBER HAVING HIGH YOUNG'S MODULUS AND HIGH TOUGHNESS

(75) Inventor: Takeshi Sugawara, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/376,051

(22) Filed: Aug. 17, 1999

(30) Foreign Application Priority Data

Aug. 18, 1998 (JP) ..... 10-247834
Aug. 18, 1998 (JP) ..... 10-247835
Jun. 30, 1999 (JP) ..... 11-185911

(51) Int. Cl.[7] ..... C21D 6/02; C22C 38/08
(52) U.S. Cl. ..... 148/622; 148/662; 148/612
(58) Field of Search ..... 148/540, 548, 148/622, 612, 662; 420/119

(56) References Cited

U.S. PATENT DOCUMENTS 805,460 A * 11/1905 Hadfield
810,531 A * 1/1906 Hadfield
921,925 A * 5/1909 Wales
1,492,567 A * 5/1924 Langenberg
2,368,418 A * 1/1945 McCarroll et al.
3,655,465 A * 4/1972 Snape et al. ..... 148/134
3,853,494 A * 12/1974 Graf ..... 420/119
4,576,653 A * 3/1986 Ray ..... 148/3
4,770,721 A * 9/1988 Yamamoto et al. ..... 148/144
5,185,044 A * 2/1993 Verhoeven et al.
5,900,082 A * 5/1999 Hewitt

FOREIGN PATENT DOCUMENTS

DE 2 205 592 10/1973
JP 04-254546 A * 9/1992 ..... C22C/38/00
ZA 72/9069 9/1973

OTHER PUBLICATIONS

ASM Handbook vol. 15: Casting, 1992, pp. 327–331.*
ASM Handbook vol. 4: Heat Treating, 1996, pp. 35 and 42–49.*
Dr. Hermann Schumann, "Metallographie" pp. 389–411 (VEB Deutcher Verlag für Grundstoffindustrie 1974) w/ English translation.

* cited by examiner

*Primary Examiner*—Roy King
*Assistant Examiner*—Harry D. Wilkins, III
(74) *Attorney, Agent, or Firm*—Armstrong, Westerman & Hattori, LLP

(57) ABSTRACT

In producing an Fe-based member, an Fe-based material comprising 0.6% by weight≦carbon (C)≦1.0% by weight silicon (Si)<2.2% by weight 0.9% by weight≦manganese (Mn)≦1.7% by weight 0.5% by weight≦nickel (Ni)≦1.5% by weight and the balance of iron (Fe) including inevitable impurities, is subjected, at a first step, to a thermal treatment at a heating temperature $T_1$ set in a range of $T_S<T_1<T_L$ wherein $T_S$ represents a solidus temperature of the Fe-based material and $T_L$ represents a liquidus temperature, and under a cooling condition set at a quenching level. At a second step, the resulting Fe-based material is subjected to a thermal treatment at a heating temperature $T_2$ set in a range of $T_e1<T_2<Te2$ wherein Te1 represents a eutectic transformation starting temperature and Te2 represents a eutectic transformation finishing temperature, and for a heating time t set in a range of 60 min≦t≦180 min. Thus, it is possible to produce an Fe-based member having a high Young's modulus and a high toughness.

9 Claims, 21 Drawing Sheets

Fe-BASED MEMBER A1
(Fe-BASED MATERIAL a1)

Fe-BASED MEMBER A11
(Fe-BASED MATERIAL a1)

Fe-BASED MATERIAL a1

25μm

Fe-BASED MEMBER A13

25μm

PROCESS FOR PRODUCING FE-BASED MEMBER HAVING HIGH YOUNG'S MODULUS, AND FE-BASED MEMBER HAVING HIGH YOUNG'S MODULUS AND HIGH TOUGHNESS

BACKGROUND OF THE INVENTION

1. Field of the Invention

The present invention relates to a process for producing an Fe-based member having a high Young's modulus and an Fe-based member having a high Young's modulus and a high toughness.

2. Description of the Related Art

There is a conventionally known method for enhancing the Young's modulus of an Fe-based member, which is to compound a dispersing material such as a reinforcing fiber, reinforcing granules and the like having a high Young's modulus to a matrix for the Fe-based member.

However, the known method suffers from problems that the dispersing material is coagulated in the matrix, and that when the surface properties are poor, the toughness of the Fe-based member is largely injured.

SUMMARY OF THE INVENTION

Accordingly, it is an object of the present invention to provide a producing process of the above-described type, wherein a particular metallographic structure can be produced by subjecting an Fe-based material having a particular composition to a particular treatment, thereby mass-producing an Fe-based member having a high Young's modulus, a high toughness or a toughness required for practical use.

To achieve the above object, according to the present invention, there is provided a process for producing an Fe-based member having a high Young's modules, comprising a first step of subjecting an Fe-based material comprising 0.6% by weight≦carbon (C)≦1.9% by weight silicon (Si)<2.2% by weight 0.9% by weight≦manganese (Mn)≦1.7% by weight 0.5% by weight≦nickel (Ni)≦1.5% by weight and the balance of iron (Fe) including inevitable impurities, to a thermal treatment at a heating temperature $T_1$ set in a range of $T_S<T_1<T_L$ wherein $T_S$ represents a solidus temperature for the Fe-based material and $T_L$ represents a liquidus temperature, and under a cooling condition set at a quenching level, and a second step of subjecting the resulting Fe-based material to a thermal treatment at a heating temperature $T_2$ set in a range of $Te1<T_2<Te2$ wherein Te1 represents a eutectic transformation-starting temperature, and Te2 represents a eutectic transformation-finishing temperature, and for a heating time t set in a range of 60 min≦t≦180 min.

If the Fe-based material having the above-described composition is subjected to the thermal treatment at the first step, the solidified structure is transformed into a primary thermally treated structure. The primary thermally treated structure is comprised of a matrix comprising martensite, a large number of massive residual γ phases, a large number of intermetallic compound phases and the like. If the conditions are changed at the first step, the primary thermally treated structure cannot be produced. In the quenching, the cooling rate CR is set higher than a usual oil-cooling level or a forcibly air-cooling level, and thus, at CR≧250° C./min.

For this quenching, for example, an oil-cooling, a water-cooling or the like may be used.

If the Fe-based material having the primary thermally treated structure is then subjected to the thermally treatment at second step, the primary thermally treated structure is transformed into a secondary thermally treated structure. The secondary thermally treated structure is comprised of a matrix, for example, comprising an α phase, a large number of fine carbide granules, a large number of massive precipitated γ phases and the like. Fine short fiber-shaped carbide phases may be included in the secondary thermally treated structure in some cases.

In the secondary thermally treated structure, the fine carbide granules contribute to an enhancement in Young's modulus of the Fe-based member, and the precipitated γ phases contribute to an enhancement in toughness of the Fe-based member.

If the heating temperature $T_2$ is lower than Te1 or the heating time t is shorter than 60 minutes at the second step, the fine division and dispersion of the carbide cannot be achieved sufficiently. On the other hand, if the heating temperature $T_2$ is higher than Te2 or the heating time t is longer than 180 minutes at the second step, the graphitization is advanced excessively, and the coagulation of the carbide is produced.

Carbon (C) in the composition of the Fe-based material produces the fine carbide granules which contribute to an enhancement in Young's modulus. To increase the amount of fine carbide granules produced, it is necessary to add a larger amount of carbon(C), and hence, the lower limit of the C content is set at 0.6% by weight. On the other hand, if C>1.9% by weight, not only the carbide content but also the graphite content are increased and further, a eutectic graphite phase is precipitated. For this reason, the Fe-based member is embrittled.

Silicon (Si) serves to promote the deoxidation and the graphitization and is dissolved as a solid solution into the α phase to reinforce the α phase. In addition, silicon (Si) has an effect of increasing the difference ΔT between the eutectic transformation starting temperature Te1 and the eutectic transformation finishing temperature Te2, namely, widening the range of the heating temperature $T_2$ at the second step. Therefore, it is desired to increase the silicon content, but if the silicon content is increased, the graphite content is increased because of the larger C content. Thus, the Si content is set at Si<2.2% by weight, preferably, at Si≦1.0% by weight.

Manganese (Mn) has an effect of promoting the deoxidation and the production of carbide and increasing the above-described temperature difference ΔT. Nickel (Ni) which is another alloy element has an effect of inhibiting the production of carbide. Therefore, the lower limit value of the Mn content is set at 0.9% by weight in order to overcome such effect of nickel (Ni) to promote production of carbide. On the other hand, if Mn>1.7% by weight, the Fe-based member is embrittled.

Nickel (Ni) is a γ-phase producing element, and has an effect of permitting a small amount of precipitated γ phases to exist at ambient temperature to confine impurities in the precipitated γ phases, thereby enhancing the toughness of the Fe-based member. To provide such an effect, it is desirable to set the Ni content at about 1% by weight. In addition, nickel (Ni) exhibits a significant effect of increasing the temperature difference ΔT. However, when the nickel(Ni) content is set at Ni<0.5% by weight, the above effects cannot be obtained. On the other hand, even if the nickel content is set at Ni>1.5% by weight, the increment of the temperature difference ΔT is not varied.

In addition, according to the present invention, there is provided a process for producing an Fe-based member, wherein the heating temperature relative to the liquidus temperature $T_L$ is set at $T_1>T_L$ and a quenching similar to that described above is carried out at a first step, and then, a second step similar to that described above is carried out, as well as a process for producing an Fe-based member, wherein the heating temperature relative to an Acm temperature and the solidus temperature $T_S$ is set in a range of $T_A \leqq T_1 \leqq T_S$ at a first step, and the second step similar to that described above is carried out.

Even with these processes, a thermally treated structure similar to the above-described secondary thermally treated structure can be produced.

Further, according to the present invention, there is provided a process for producing an Fe-based member having a high Young's modulus and a high toughness, comprising a first step of subjecting an Fe-based material comprising 0.6% by weight≦carbon (C)≦1.9% by weight silicon (Si)<2.2% by weight 0.9% by weight≦manganese (Mn)≦1.7% by weight 0.5% by weight≦nickel (Ni)≦1.5% by weight Ni (% by weight)/Mn (% by weight)≦1.12 and the balance of iron (Fe) including inevitable impurities, to a thermal treatment at a heating temperature $T_1$ set at $T_1 \geqq T_A$ wherein $T_A$ represents an Acm temperature for the Fe-based material, and under a cooling condition set at a quenching level, and a second step of subjecting the resulting Fe-based material to a thermal treatment at a heating temperature $T_2$ set in a range of $T_S1 \leqq T_2 \leqq T_S2$ wherein $T_S1$ represents a temperature when the amount of carbon solid solution in a matrix of the Fe-based material is 0.16% by weight, and $T_S2$ represents a temperature when the carbon solid solution is 0.40% by weight.

If the Fe-based material having the above-described composition is subjected to the thermal treatment at the first step, the solidified structure is transformed into a primary thermally treated structure. The primary thermally treated structure is comprised of a matrix comprising, for example, martensite, a large number of massive residual γ phases and the like. If the conditions are changed at the first step, a primary thermally treated structure as described above cannot be produced. In the quenching, the cooling rate CR is set higher than a usual oil-cooling level or a forcibly air-cooling level, and thus, at CR≧250° C./min. For this quenching, for example, oil-cooling, water-cooling or the like may be used.

If the Fe-based material having the primary thermally treated structure is then subjected to the thermally treatment at second step, the primary thermally treated structure is transformed into a secondary thermally treated structure. At the second step, the amount of carbon dissolved as a solid solution into the matrix is suppressed into a range of 0.16% by weight≦SC≦0.40% by weight, in accordance with this, the precipitation of the fine granular carbide is promoted. Therefore, the secondary thermally treated structure is comprised of a matrix comprising, for example, an α phase, a large number of fine carbide granules, a large number of graphite grains, a large number of massive precipitated γ phases and the like. The heating time t at the second step is suitable to be in a range of 30 min≦t≦180 min. Fine short fiber-shaped carbide phases may be included in the secondary thermally treated structure in some cases.

In the secondary thermally treated structure, the fine carbide granules contribute to an enhancement in Young's modulus of the Fe-based member, and the precipitated γ phases contribute to an enhancement in toughness of the Fe-based member.

If the heating temperature $T_2$ at the second step is lower than $T_S1$, the amount CS of carbon solid solution in the matrix is smaller, and the amount of the fine carbide granules is also smaller. On the other hand, if the heating temperature $T_2$ is higher than $T_S2$, the carbon solid solution is increased, but the amount of fine carbide granules precipitated is decreased. The heating time t shorter than 30 minutes corresponds to a case where $T_2<T_S1$, and t>180 minutes corresponds to a case where $T_2>T_S2$.

In the composition of the Fe-based material, carbon (C) produces the fine carbide granules contributing to an enhancement in Young's modulus. To increase the amount of fine carbide granules produced, it is necessary to add large amount of carbon (C), and hence, the lower limit of the C content is set at 0.6% by weight. On the other hand, if C>1.9% by weight, not only the carbide content but also the graphite content are increased and further, a eutectic carbide and a eutectic graphite are precipitated. For this reason, the Fe-based member is embrittled. To enhance the Young's modulus and the toughness of the Fe-based member, the C content is preferably smaller than 1.0% by weight.

Silicon (Si) serves to promote the deoxidation and the graphitization and is dissolved as a solid solution into the α phase to reinforce the α phase. If the silicon content is increased, the graphite content is increased because of the larger C content. Thus, the Si content is set at Si<2.2% by weight, preferably, at Si≦1.0% by weight.

Manganese (Mn) has an effect of promoting the deoxidation and the production of fine carbide granules and widening the area where the α-, γ- and graphite-phases coexist. However, the Mn content is smaller than 0.9% by weight, the amount of carbide produced is decreased. On the other hand, if Mn>1.7% by weight, the Fe-based member is embrittled.

Nickel (Ni) is a γ-phase producing element, and has an effect of permitting a small amount of precipitated γ phases to exist at ambient temperature to confine impurities in the precipitated γ phases, thereby enhancing the toughness of the Fe-based member. To provide such an effect, it is desirable to set the Ni content at about 1% by weight. In addition, nickel (Ni) exhibits a significant effect for increasing a temperature difference ΔT between the temperatures $T_S1$ and $T_S2$. However, if the nickel content is smaller than 0.5% by weight, both of such effects cannot be obtained. On the other hand, even if the Ni content is set at Ni>1.5% by weight, the increment of the temperature difference ΔT is not varied.

In this case, if the ratio of the Ni content to the Mn content is Ni (% by weight)/Mn (% by weight)>1.12, the content of graphite in the Fe-based member is increased, resulting in a reduced Young's modulus.

If required, aluminum (Al) and nitrogen (N) may be added to the Fe-based material in addition to the above-described alloy elements. Aluminum (Al) has an effect of promoting the deoxidation and widening the area where the α-, γ- and graphite-phases coexist, as does manganese (Mn), and is an a phase and graphite producing element. The usual upper limit value of the Al content is 1.2% by weight. A small amount of nitrogen (N) added exhibits an effect widening the area where the α-, γ- and graphite-phases coexist. However, if nitrogen (N) is not completely dissolved as a solid solution into the matrix, it causes voids to be produced, resulting in degraded mechanical properties of the member, and it becomes a nucleus for graphite, thereby bringing about an increase in graphite content. Therefore, the upper limit value of the N content is set at 0.45% by weight.

It is another object of the present invention to provide the producing process of the above-described type, wherein a particular metallographic structure can be produced by subjecting an Fe-based material having a particular composition to a particular thermal treatment, thereby mass-producing an Fe-based member which has both of a high Young's modulus and a high toughness; has a good cold workability and moreover, has mechanical properties which are not degraded.

To achieve the above object, according to the present invention, there is provided a process for producing an Fe-based member having a high Young's modulus and a high toughness, comprising a first step of preparing an Fe-based material comprising 0.6% by weight≦carbon (C)≦1.0% by weight silicon (Si)<2.2% by weight 0.9% by weight≦manganese (Mn)≦1.7% by weight 0.5% by weight≦nickel (Ni)≦1.5% by weight Ni (% by weight)/Mn (% by weight)≦1.12

0.3% by weight≦AE≦1.5% by weight and the balance of iron (Fe) including inevitable impurities, wherein AE is at least one alloy element selected from the group consisting of Ti, V, Nb, W and Mo, and subjecting the Fe-based material to a thermal treatment at a heating temperature $T_1$ set at $T_1 \geqq T_A3$ wherein $T_A3$ represents the $A_3$ temperature of the Fe-based material and under a cooling condition set at a quenching level, and a second step of subjecting the resulting Fe-based material to a thermal treatment at a heating temperature $T_2$ set in a range of $T_S1 \leqq T_2 \leqq T_S2$ wherein $T_S1$ represents a temperature when the amount of carbon solid solution in a matrix of the Fe-based material is 0.16 & by weight, and $T_S2$ represents a temperature when the amount of carbon solid solution is 0.40% by weight.

If the Fe-based material having the above-described composition is subjected to the thermal treatment at the first step, the solidified structure is transformed into a primary thermally treated structure. The primary thermally treated structure is comprised of a matrix comprising, for example, martensite, a large number of massive residual γ phases and the like. If the conditions are changed at the first step, a primary thermally treated structure as described above cannot be produced. In the quenching, the cooling rate CR is set higher than a usual oil-cooling level or a forcibly air-cooling level, and thus, at CR≧250° C./min. For this quenching, for example, oil-cooling, water-cooling or the like may be used.

If the Fe-based material having the primary thermally treated structure is then subjected to the thermally treatment at second step, the primary thermally treated structure is transformed into a secondary thermally treated structure. At the second step, the amount SC of carbon dissolved as a solid solution into the matrix is suppressed into a range of 0.16% by weight≦SC≦0.40% by weight, and in accordance with this, the precipitation of fine granular carbide is promoted, whereby the matrix is transformed into a hypo-eutectic structure in cooperation with an effect of the alloy element AE. Therefore, the secondary thermally treated structure is comprised of a large number of fine carbide granules, a large number of graphite grains, a large number of massive precipitated γ phases and the like which are dispersed in a matrix of the hypo-eutectic structure. The heating time t at the second step is suitable to be in a range of 30 min≦t≦180 min. Fine short fiber-shaped carbide phases may be included in the secondary thermally treated structure in some cases.

In the secondary thermally treated structure, the fine carbide granules contribute to an enhancement in Young's modulus of the Fe-based member, and the precipitated γ phases contribute to an enhancement in toughness of the Fe-based member. If the welding is carried out when the matrix is of a hyper-eutectic structure, a net-shaped carbide phase is produced, resulting in degraded mechanical properties. However, such disadvantage is avoided by transforming the matrix into the hypo-eutectic structure, as described above.

If the heating temperature $T_2$ is lower than $T_S1$ at the second step, the amount of fine carbide granules precipitated is smaller. On the other hand, if the heating temperature $T_2$ is higher than $T_S2$, the amount CS of carbon solid solution is increased, but the amount of fine carbide granules precipitated is decreased. The heating time t shorter than 30 minutes corresponds to a case where $T_2<T_S1$, and T>180 minutes corresponds to a case where $T_2>T_S2$.

Carbon (C) in the composition of the Fe-based material produces the fine carbide granules which contribute to an enhancement in Young's modulus. To increase the amount of fine carbide granules produced, it is necessary to add large amount of carbon(C), and hence, the lower limit of the C content is set at 0.6% by weight. On the other hand, if C>1.0% by weight, the carbide content is too large and for this reason, the Fe-based member is embrittled.

Silicon (Si) serves to promote the deoxidation and the graphitization and is dissolved as a solid solution into the α phase to reinforce the α phase. If the silicon content is increased, the graphite content is increased. Therefore, the Si content is set at Si<2.2% by weight, preferably, at Si≦1.0% by weight.

Manganese (Mn) has an effect of promoting the deoxidation and the production of carbide and widening the area where the α-, γ- and graphite phases coexist. However, if the Mn content is less than 0.9% by weight, the amount of carbide produced is decreased. On the other hand, if Mn>1.7% by weight, the Fe-based member is embrittled.

Nickel (Ni) is a γ-phase producing element, and has an effect of permitting a small amount of precipitated γ phases to exist at ambient temperature to confine impurities in the precipitated γ phases, thereby enhancing the toughness of the Fe-based member. To provide such an effect, it is desirable to set the Ni content at about 1% by weight. In addition, nickel (Ni) exhibits a significant effect for increasing the temperature difference ΔT between the temperatures $T_S1$ and $T_S2$. Further, nickel (Ni) has an effect for enhancing the elongation of the Fe-based member at ambient temperature, and enhancing the flexure characteristic to improve the cold workability. However, if the nickel content is set smaller than 0.5% by weight, the above-described effects cannot be obtained. On the other hand, even if the Ni content is set at Ni>1.5% by weight, the increment of the temperature difference ΔT is not varied.

In this case, if the ratio of the Ni content to the Mn content is Ni (% by weight)/Mn (% by weight)>1.12, the amount of graphite in the Fe-based member is increased, resulting in a reduced Young's modulus.

Ti, V, Nb, W and Mo which are alloy elements AE have an effect of producing carbide at an early stage and reducing the concentration of C in the matrix to transform the matrix into the hypo-eutectic structure, because they are more active than Fe and Mn. Thus, it is possible to prevent the degradation of the mechanical properties of the Fe-based member due to the welding, and to enhance the cold workability of the Fe-based member. Particularly, there is an advantage that Ti also has a deoxidizing effect, and the titanium carbide has a specific rigidity. Further, if two or more of the alloy elements AE are added in combination, a carbide finely-dividing effect is exhibited. In this case, Ti and Nb produce carbides earlier than the finish of the solidification of the γ phase and hence, such carbides act as nuclei for the γ phase. Therefore, there is not raised such a disadvantage that the carbide of Ti and Nb exist in the crystal boundary to retard the toughness of the Fe-based member. On the other hand, carbides of V, W and Mo are dissolved as solid solutions into the γ phase and precipitated in the granular forms and hence, it is possible to suppress the reduction in toughness of the Fe-based member to the minimum.

However, if the content of the alloy element AE is less than 0.3% by weight, the matrix is transformed into a hyper-eutectic structure and hence, this content is not preferred. On the other hand, if AE>1.5% by weight, the amount of the carbide existing in the crystal boundary between the γ phases is more than 2% in terms of the volume fraction Vf and for this reason, the toughness of the Fe-based member is retarded. The upper limit value of the Ti content is 1.2% by weight, and the upper limit value of the V content is 1.27% by weight.

In addition to the above-described alloy elements, if required, aluminum (Al) and nitrogen (N) may be added to the Fe-base material. Aluminum (Al) has an effect of promoting the deoxidation and widening the area where the α-, γ- and graphite-phases coexist, as does manganese. In addition, aluminum (Al) is an α phase and graphite producing element. The usual upper limit value of the Al content is 1.2% by weight. A small amount of nitrogen (N) added exhibits an effect of widening the area where the α-, γ- and graphite-phases coexist. However, if nitrogen (N) is completely not dissolved as a solid solution, it produces voids to degrade the mechanical properties of the member, and it becomes a nucleus to bring out an increase in content of graphite. Therefore, the upper limit value of the N content is set at 0.45% by weight.

The above and other objects, features and advantages of the invention will become apparent from the following description of the preferred embodiment taken in conjunction with the accompanying drawings.

DESCRIPTION OF THE PREFERRED EMBODIMENTS

EXAMPLE I

Table 1 shows compositions of Fe-based materials a1 to a4. The Fe-based materials a1 to a4 were produced by a die-casting process.

TABLE 1

| | Chemical constituent (% by weight) | | | | | | |
|---|---|---|---|---|---|---|---|
| | C | Si | Mn | P | S | Ni | Fe |
| Fe-based material a1 | 0.8 | 0.49 | 1.04 | 0.007 | 0.005 | 1.09 | Balance |
| Fe-based material a2 | 1.2 | 0.21 | 1.07 | 0.007 | 0.005 | 1.21 | Balance |
| Fe-based material a3 | 1.61 | 0.28 | 1.08 | 0.006 | 0.006 | 1.21 | Balance |
| Fe-based material a4 | 2.05 | 2.05 | 0.65 | <0.04 | <0.04 | — | Baiance |

[I] Example with Heating Temperature $T_1$ Set in a Range of $T_S<T_1<T_L$

Figure 1:
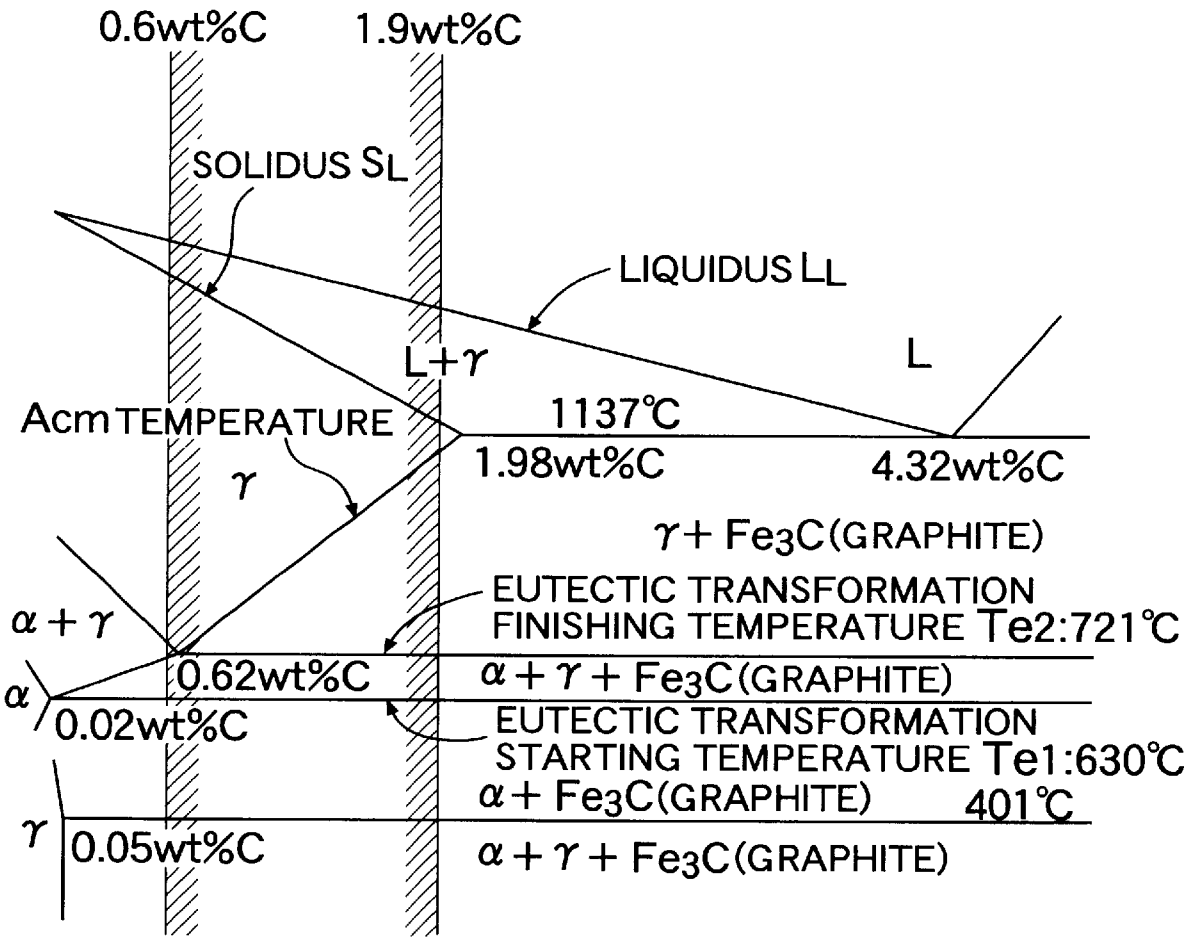
FIG. 1 is a partial state diagram of an Fe-based material.

FIG. 1 shows a portion of a state diagram of the Fe-based material a1. In this case, the solidus temperature $T_S$ and the liquidus temperature $T_L$ coexist on a solidus $S_L$ and a liquidus $L_L$, respectively, in a range of 0.6% by weight≦C≦1.9% by weight. The eutectic transformation starting temperature Te1 is 630° C., and the eutectic transformation finishing temperature Te2 is 721° C. For an Fe-based material a4, the solidus temperature $T_S$ is 1159° C.; the liquidus temperature $T_L$ for the Fe-based material a4 is 1319° C., the eutectic transformation starting temperature Te1 is 747° C.; and the eutectic transformation finishing temperature Te2 is 782° C.

Figure 2:
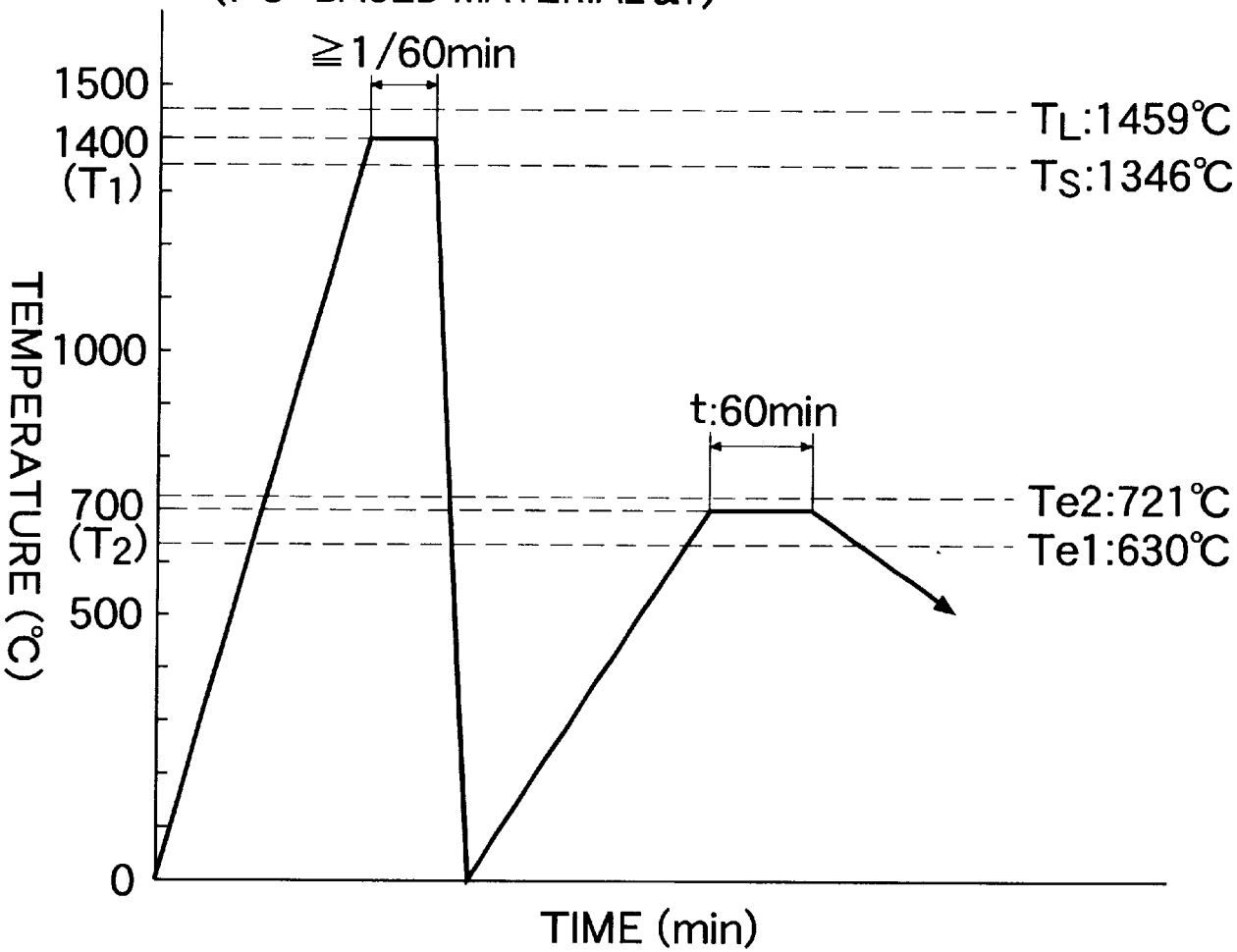
FIG. 2 is a diagram of a heat cycle for producing an Fe-based member A1.
Figure 3:
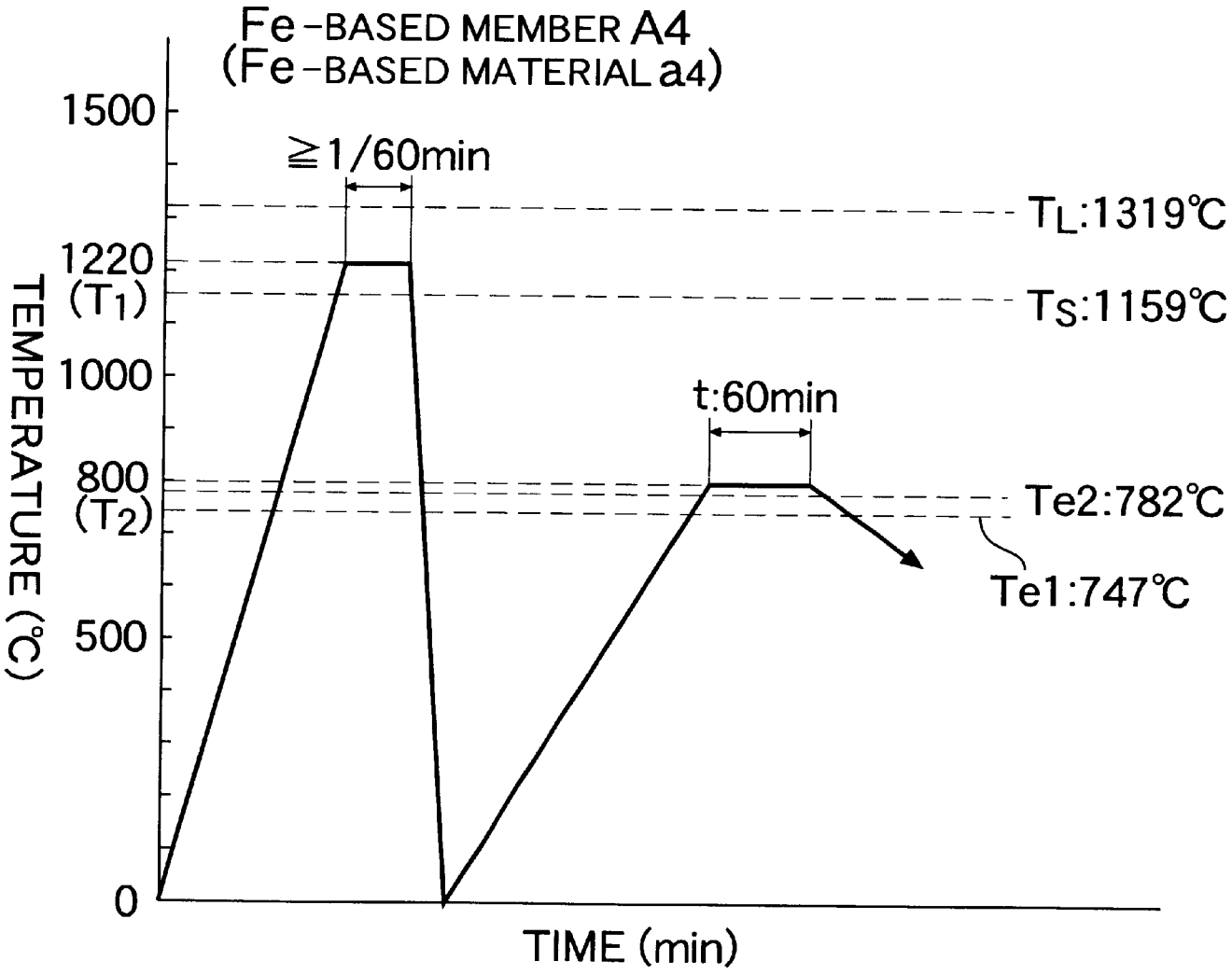
FIG. 3 is a diagram of a heat cycle for producing an Fe-based member A4.

Both the Fe-based materials a1 and a4 were subjected to the first and second steps under conditions shown in Table 2 and FIGS. 2 and 3 to produce an Fe-based member A1 corresponding to the Fe-based material a1 and an Fe-based member A4 corresponding to the Fe-based material a4.

TABLE 2

| | First step | | Second step | | |
|---|---|---|---|---|---|
| | Heating temperature (° C.) | Cooling rate (° C./min) | Heating temperature (° C.) | Heating time (min) | Cooling type |
| Fe-based member A1 | $T_1$: 1400<br>$T_S$: 1346<br>$T_L$: 1459 | CR: 1300 | $T_2$: 700<br>$Te_1$: 630<br>$Te_2$: 721 | t: 60 | air-cooling |
| Fe-based member A4 | $T_1$: 1220<br>$T_S$: 1159<br>$T_L$: 1319 | CR: 1300 | $T_2$: 800<br>$Te_1$: 747<br>$Te_2$: 782 | t: 60 | air-cooling |

Figure 4:
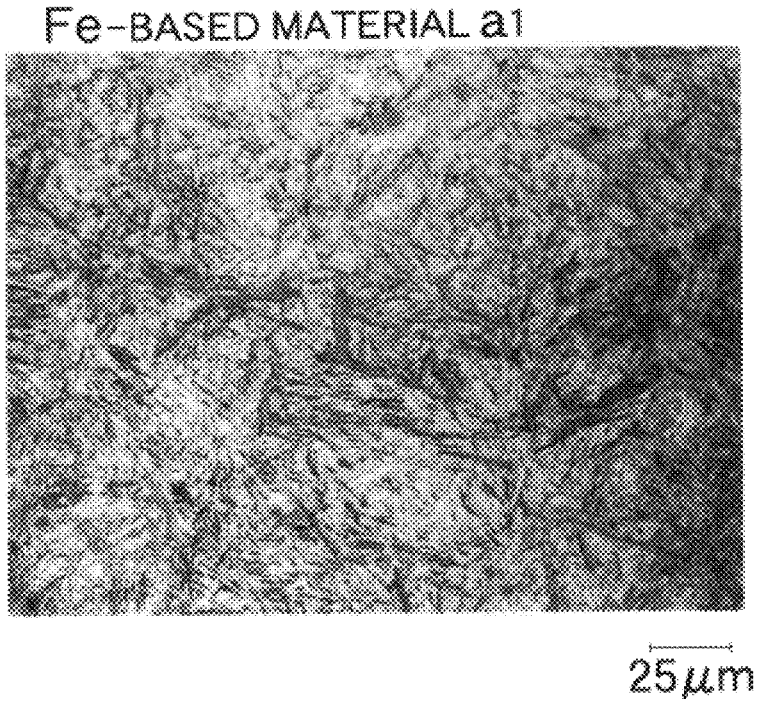
FIG. 4 is a photomicrograph showing a primary thermally treated structure of an Fe-based material a1.
Figure 5:
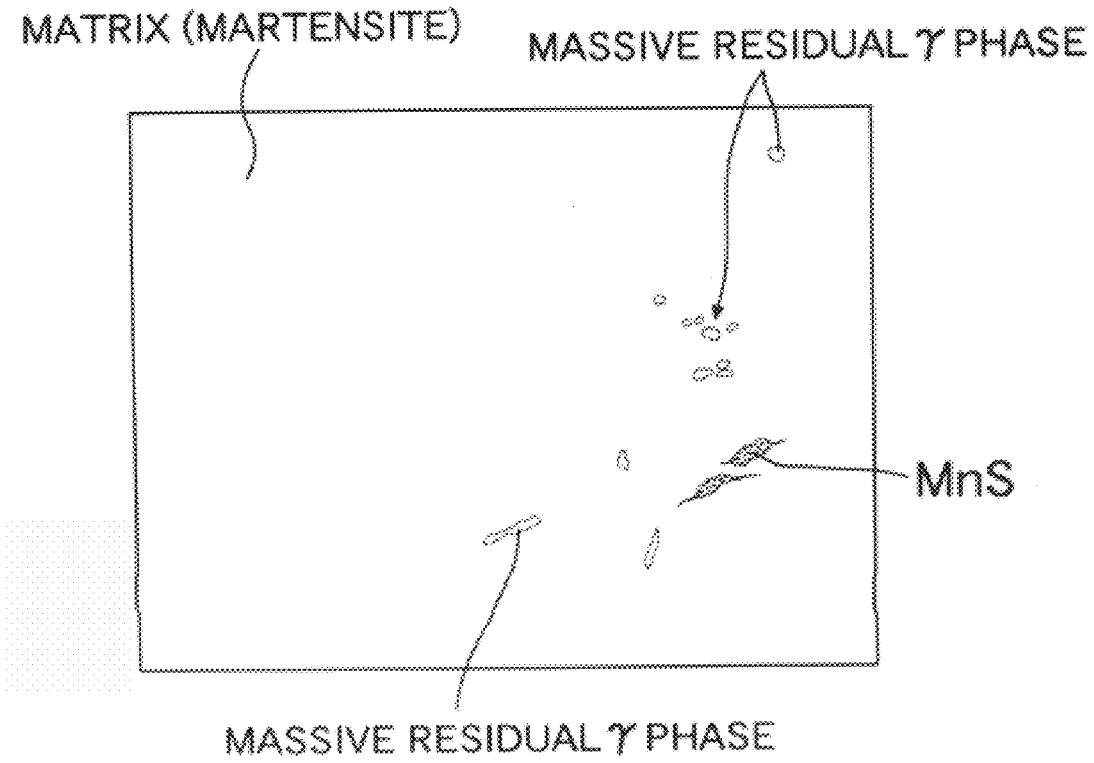
FIG. 5 is a schematic tracing of FIG. 4.

FIG. 4 is a photomicrograph showing a primary thermally treated structure of the Fe-based material a1 resulting from the treatment at the first step, and FIG. 5 is a schematic tracing of FIG. 4. The primary thermally treated structure is comprised of a matrix comprising martensite, a large number of massive residual γ phases, a large number of intermetallic compound phases (MnS and the like) and the like.

Figure 6:
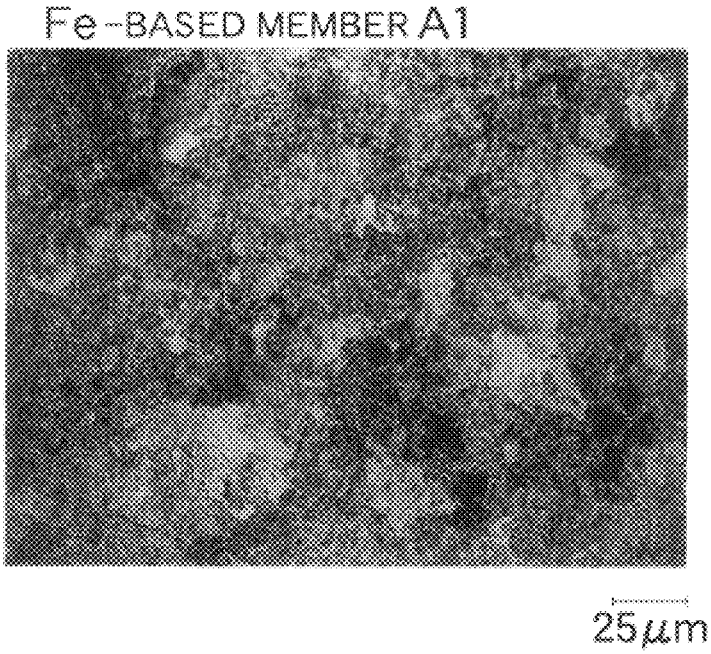
FIG. 6 is a photomicrograph showing a secondary thermally treated structure of the Fe-based material A1.
Figure 7:
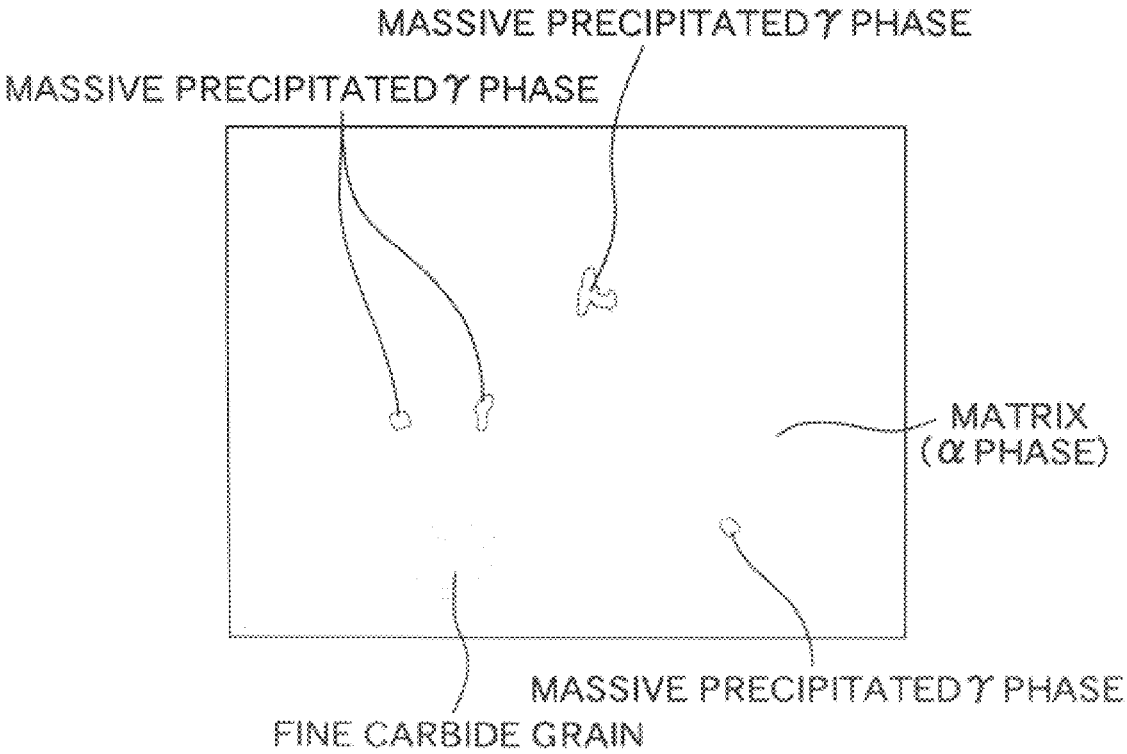
FIG. 7 is a schematic tracing of FIG. 6.

FIG. 6 is a photomicrograph showing a secondary thermally treated structure of the Fe-based member A1, and FIG. 7 is a schematic tracing of the FIG. 6. The secondary thermally treated structure is comprised of a matrix comprising an α phase, a large number of fine carbide grains (mainly, $Fe_3C$), a large number of massive precipitated γ phases and the like.

In the secondary thermally treated structure, the fine carbide granules which are fine carbide contribute to an enhancement in Young's modulus of the Fe-based member A1. In this case, it is desirable that the average number of the fine carbide granules per 1 $\mu m^2$ is equal to or more than 1.05. This amount of the fine carbide granules was determined by a procedure which comprises carrying out an image analysis of the metallographic structure by a metal microscope or the like to determine the number of fine carbide granules per 1 $\mu m^2$ at a plurality of points, and calculating the average value of the numbers determined at the points. When the fine fiber-shaped carbide phases is included in the secondary thermally treated structure, they also contribute to the enhancement in Young's modulus of. the Fe-based member A1.

The precipitated γ phases confine impurities therein to contribute to an enhancement in toughness of the Fe-based member A1. For this purpose, it is desirable that the content d of the precipitated γ phases is equal to or larger than 0.8% by weight ($d \geqq 0.8\%$ by weight). The content d of the precipitated γ phases was determined by the calculation from the state diagram using a thermodynamic data base such as Thermo-Calc and the like.

For both of the Fe-based members A1 and A4, the average number of the fine carbide granules per 1 $\mu m^2$ and the content d of the precipitated γ phases were determined by the above-described method, and the tensile test was carried out to determine the tensile strength and the Young's modulus. Further, the Charpy impact test was carried out to determine a Charpy impact test, thereby providing results shown in Table 3. An Fe-based member A11 in Table 3 will be described hereinafter.

TABLE 3

| | average number of fine carbide granules per 1 $\mu m^2$ | content d of precipitated γ phases (% by weight) | tensile strength (MPa) | Young's modulus (GPa) | Charpy impact value ($J/cm^2$) |
|---|---|---|---|---|---|
| Fe-based member A1 | 1.05 | 1.76 | 867 | 235 | 28.9 |
| Fe-based member A4 | 0 | — | 739 | 193 | 6.2 |
| Fe-based member A11 | 1.05 | 1.76 | 877 | 241 | 15 |

As apparent from Table 3, it can be seen that the Fe-based member A1 according to the example of present invention has a Young's modulus increased about 1.2 times, a Charpy impact value increased about 4.7 times, and a strength increased about 1.2 times as high as those of the Fe-based member A4 according to the comparative example and hence, has a higher Young's modulus, a higher toughness and a higher strength.

[II] Example with Heating Temperature $T_1$ Set at $T_1 > T_L$

Figure 8:
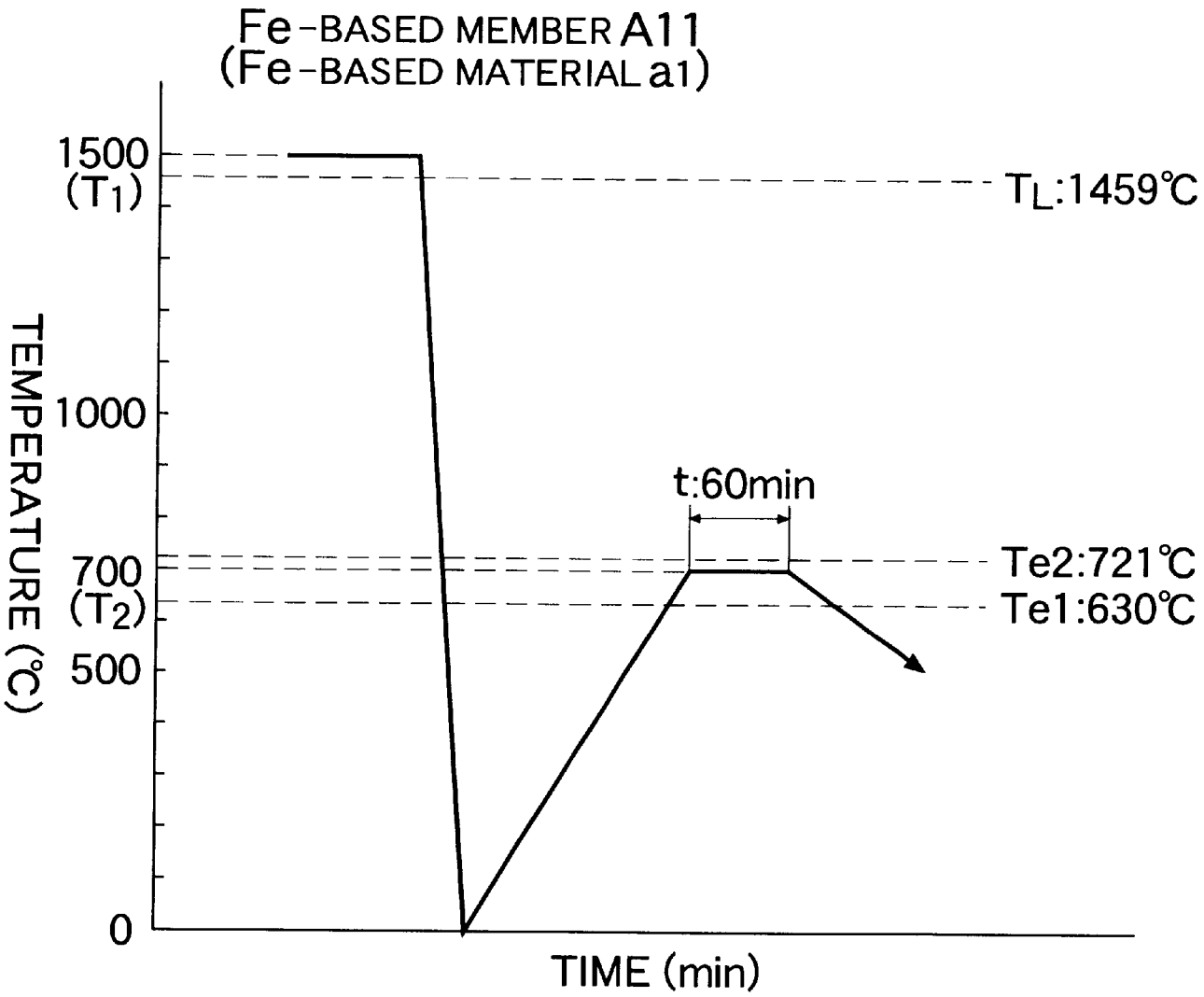
FIG. 8 a diagram of a heat cycle for producing an Fe-based member A11.

The Fe-based material a1 shown in Table 1 was used and molten at a heating temperature $T_1$ equal to 1,500° C. ($T_1 > T_L = 1{,}459°$ C.) as shown in FIG. 8; then quenched (CR: 1,300° C./min) and thereafter subjected to a treatment at the second step, similar to that for the Fe-based member A1, thereby producing an Fe-based member A11. It was ascertained as a result of the microscopic examination that the Fe-based member A11 has a thermally treated structure similar to the secondary thermally treated structure of the Fe-based member A1.

The average number of the fine carbide granules per 1 $\mu m^2$ and the like in the Fe-based member A11 was examined in the same manner, thereby providing the result shown in Table 3. It can be seen from Table 3 that the Fe-based member A11 has characteristics similar to those of the Fe-based member A1, except that the toughness is lower than that of the Fe-based member A1.

Figure 9:
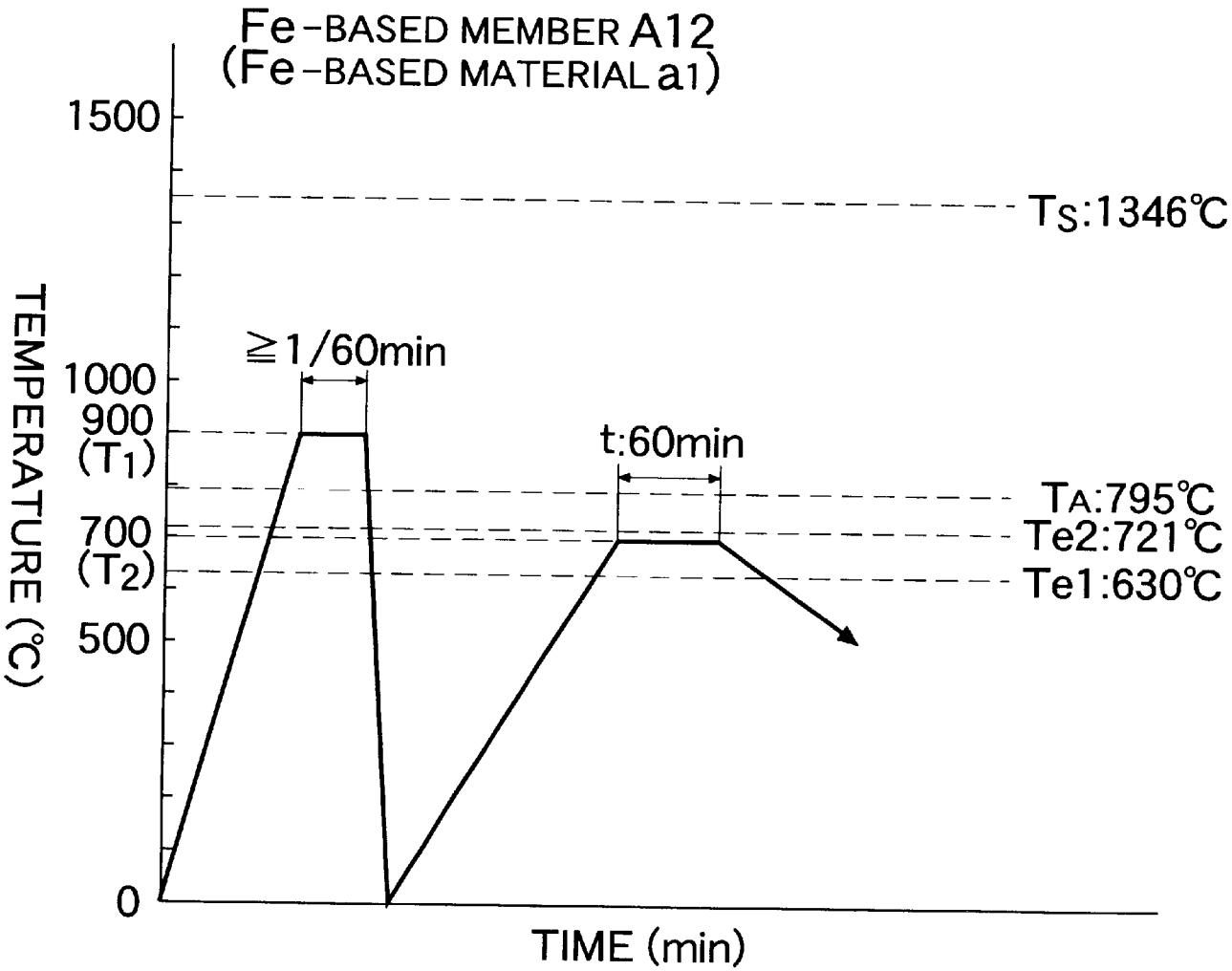
FIG. 9 is a diagram of heat cycle for producing an Fe-based member A12.
Figure 10:
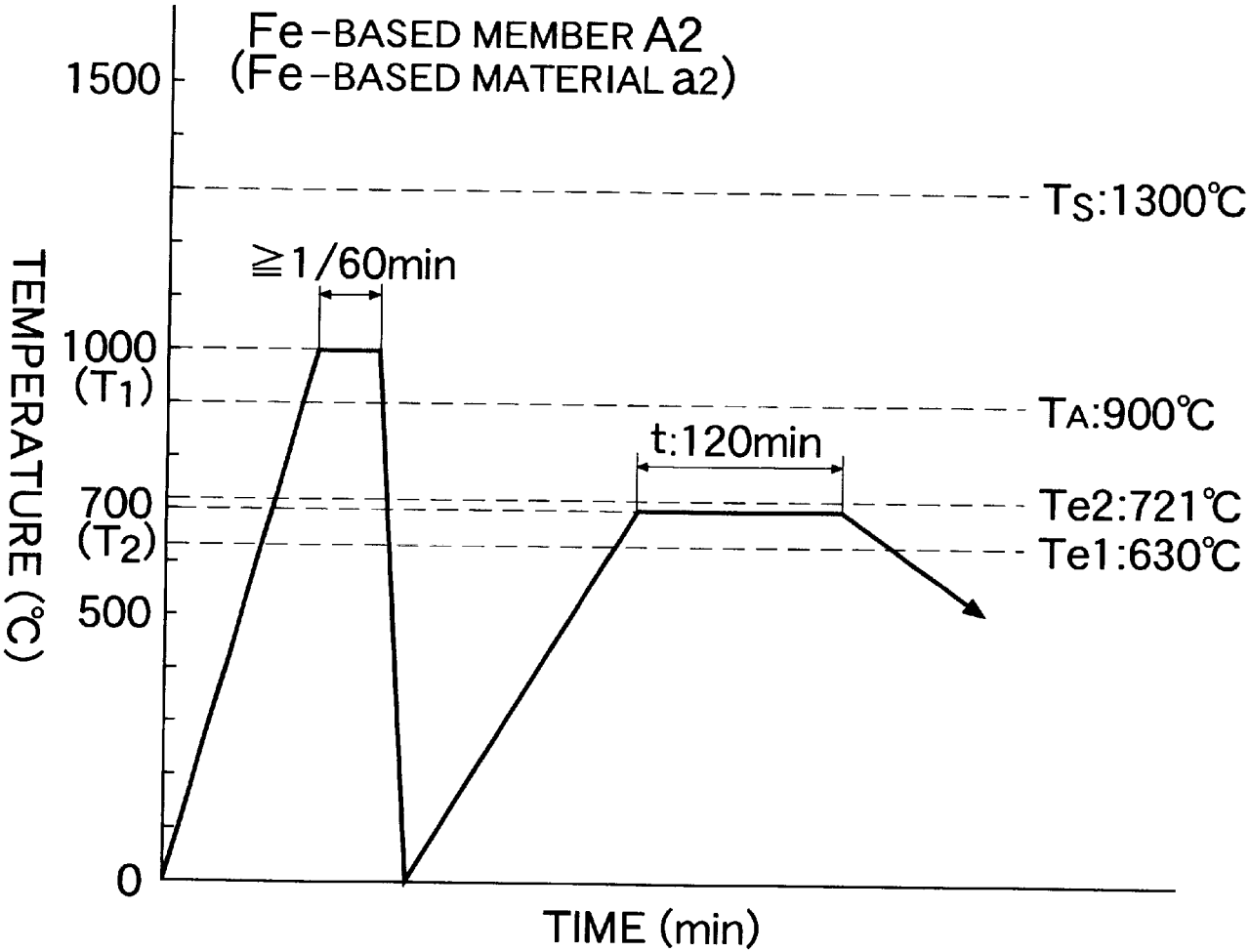
FIG. 10 is a diagram of heat cycle for producing an Fe-based member A2.
Figure 11:
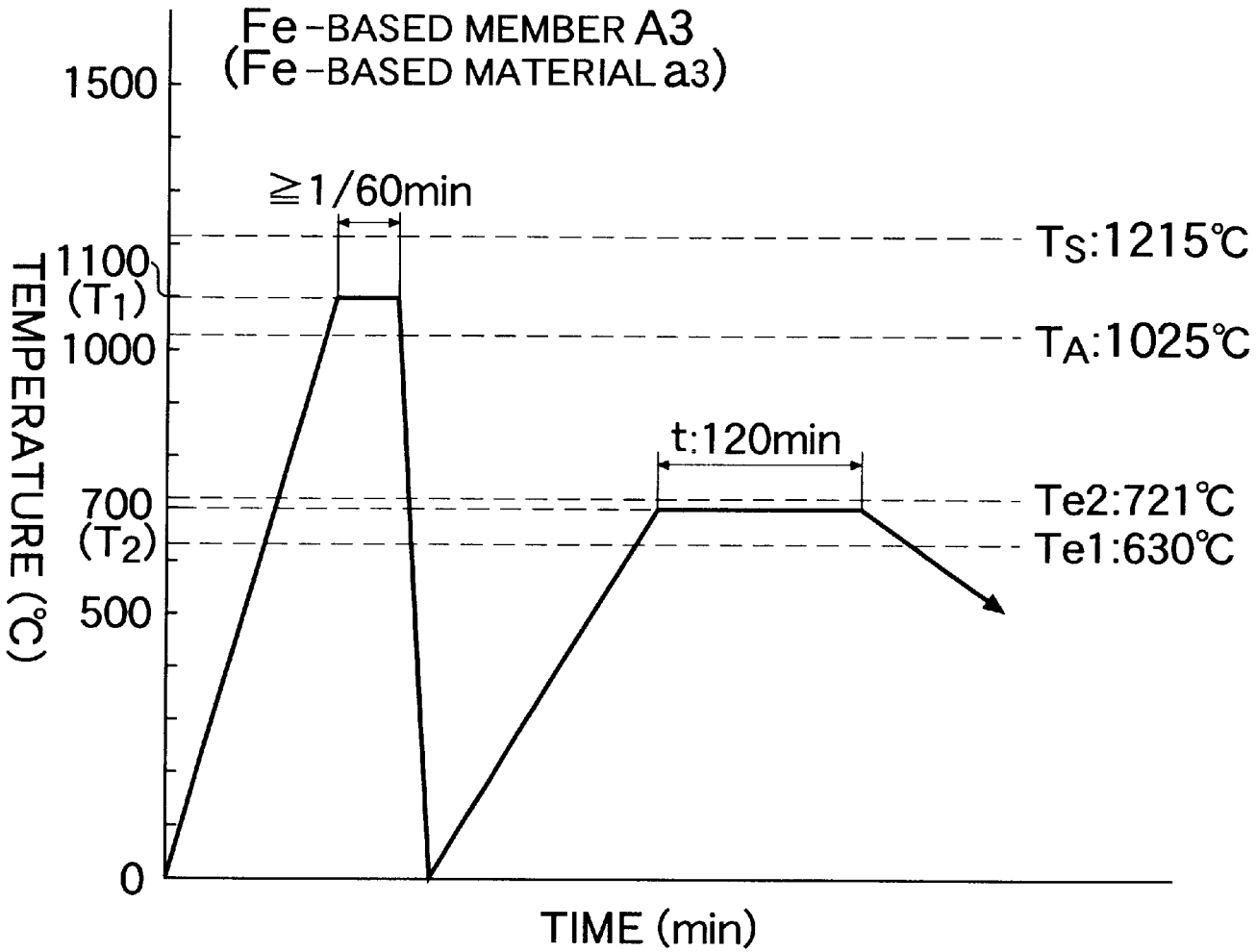
FIG. 11 is a diagram of heat cycle for producing an Fe-based member A3.

[III] Example with Heating Temperature $T_1$ Set in Range of $T_A$ (Acm Temperature)$< T_1 < T_S$ The Fe-based materials a1, a2 and a3 shown in Table 1 were used and subjected to the treatments at the first and second steps under conditions shown in Table 4 and FIGS. 9 to 11, thereby producing Fe-based members A12, A2 and A3 corresponding to the Fe-based materials a1, a2 and a3, respectively.

TABLE 4

| | First step | | Second step | | |
|---|---|---|---|---|---|
| | Heating temperature (° C.) | Cooling rate (° C./min) | Heating temperature (° C.) | Heating time (min) | Cooling type |
| Fe-based member A12 | $T_1$: 900<br>$T_A$: 795<br>$T_S$: 1346 | CA: 1300 | $T_2$: 700<br>Te1: 630<br>Te2: 721 | t: 60 | air-cooling |
| Fe-based member A2 | $T_1$: 1000<br>$T_A$: 900<br>$T_S$: 1300 | CA: 1300 | $T_2$: 700<br>Te1: 630<br>Te2: 721 | t: 120 | air-cooling |

TABLE 4-continued

| | First step | | Second step | | |
|---|---|---|---|---|---|
| | Heating temperature (° C.) | Cooling rate (° C./min) | Heating temperature (° C.) | Heating time (min) | Cooling type |
| Fe-based member A3 | $T_1$: 1100<br>$T_A$: 1025<br>$T_S$: 1215 | CA: 1300 | $T_2$: 700<br>Te1: 630<br>Te2: 721 | t: 120 | air-cooling |

It was ascertained as a result of the microscopic examination that each of the Fe-based members A12, A2 and A3 has a secondary thermally treated structure similar to the secondary thermally treated structure of the Fe-based member A1.

The average number of the fine carbide granules per 1 $\mu m^2$ and the like in each of the Fe-based member A12, A2 and A3 was examined in the same manner, thereby providing results shown in Table 5.

TABLE 5

| | average number of fine carbide granules per 1 $\mu m^2$ | content d of precipitated γ phases (% by weight) | tensile strength (MPa) | Young's modulus (GPa) | Charpy impact value ($J/cm^2$) |
|---|---|---|---|---|---|
| Fe-based member A12 | 1.05 | 1.76 | 873 | 244 | 31.1 |
| Fe-based member A2 | 0.23 | 1.75 | 665 | 231 | 3.8 |
| Fe-based member A3 | 1.04 | 1.73 | 941 | 259 | 3 |

It can be seen Table 5 that the Fe-based member A12 has characteristics similar to those of the Fe-based member A1. Each of the Fe-based members A2 and A3 has a higher Young's modulus, but has a lower toughness. If the Fe-base member has such a degree of toughness, it is believed that there is no hindrance in practical use, depending on service conditions, though.

The first step of carrying out the quenching with the heating temperature $T_1$ for Fe-based material set in the range of $T_S<T_1<T_L$, as in Example [I], corresponds to a thixocasting process which comprises pouring a semi-molten Fe-based material having solid and liquid phases coexisting therein into a mold having a good thermal conductivity under a pressure. Therefore, a producing process in which the second step is carried out after carrying-out of a thixocasting step, is included in the present invention.

The first step for carrying out the quenching with the heating temperature $T_1$ for Fe-based material set at $T_1>T_L$, as in Example [II], corresponds to a casting process which comprises pouring a molten metal into a mold having a good thermal conductivity. Therefore, a producing process in which the second step is carried out after carrying-out of the casting step as just described above, is included in the present invention.

EXAMPLE II

In this EXAMPLE, the Fe-based materials a1 and a2 are used.

The Acm temperature $T_A$ and the solidus temperature $T_S$ (the upper limit value of the heating temperature $T_1$ in the embodiment) as well as the temperature $T_S1$ when the C-solid solution amount CS=0.16% by weight and the temperature $T_S2$ when CS=0.40% by weight are as shown in Table 6.

TABLE 6

| | First step | | Second step | | |
|---|---|---|---|---|---|
| | Heating temperature (° C.) | Cooling rate (° C./min) | Heating temperature (° C.) | Heating time (min) | Cooling type |
| Fe-based member A13 | $T_1$: 900<br>$T_A$: 795<br>$T_S$: 1346 | CA: 1300 | $T_2$: 700<br>$T_S1$: 692<br>$T_S2$: 708 | t: 60 | air-cooling |
| Fe-based member A21 | $T_1$: 1000<br>$T_A$: 900<br>$T_S$: 1300 | CA: 1300 | $T_2$: 700<br>$T_S1$: 697<br>$T_S2$: 711 | t: 120 | air-cooling |

Figure 12:
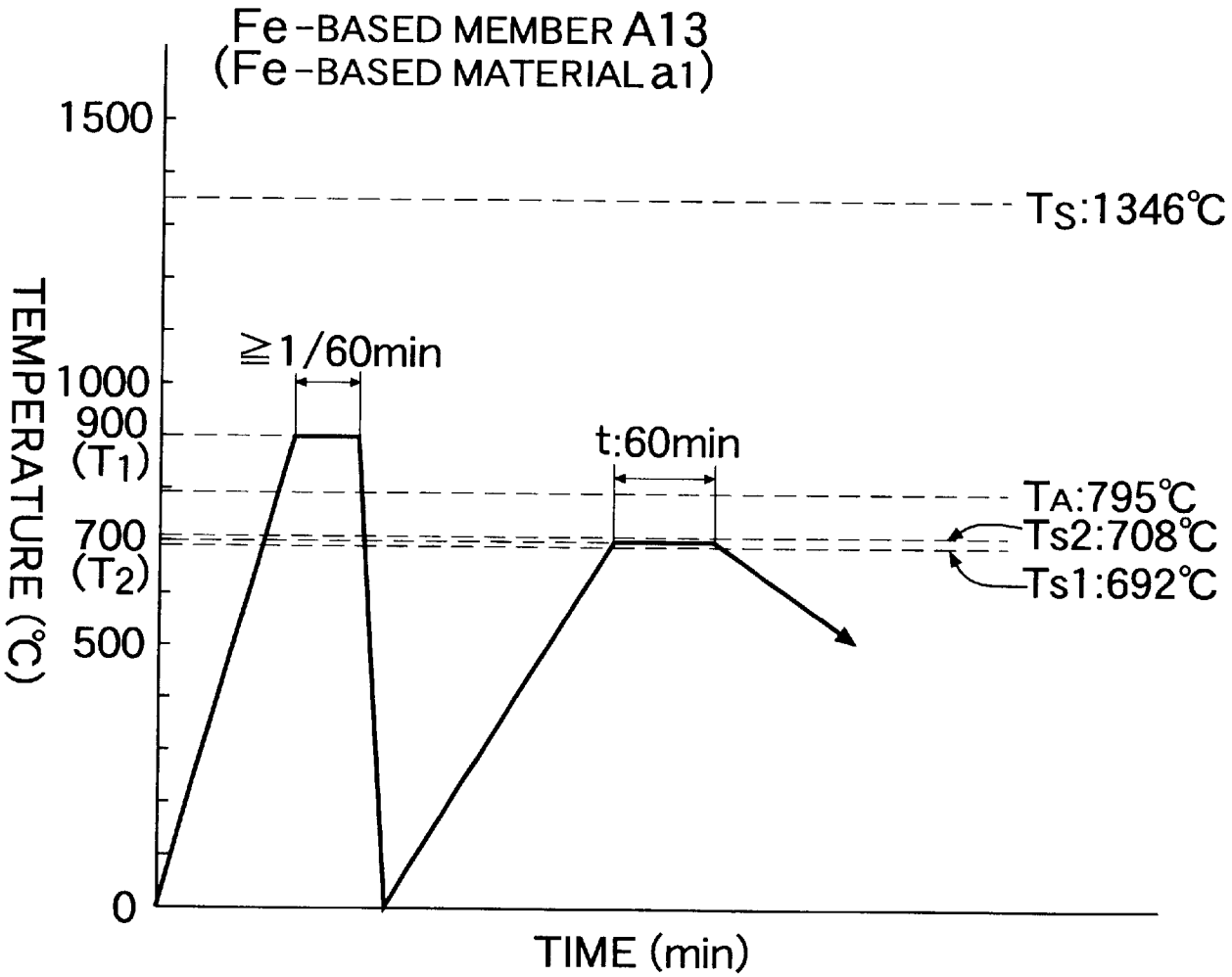
FIG. 12 is a diagram of heat cycle for producing an Fe-based member A13.
Figure 13:
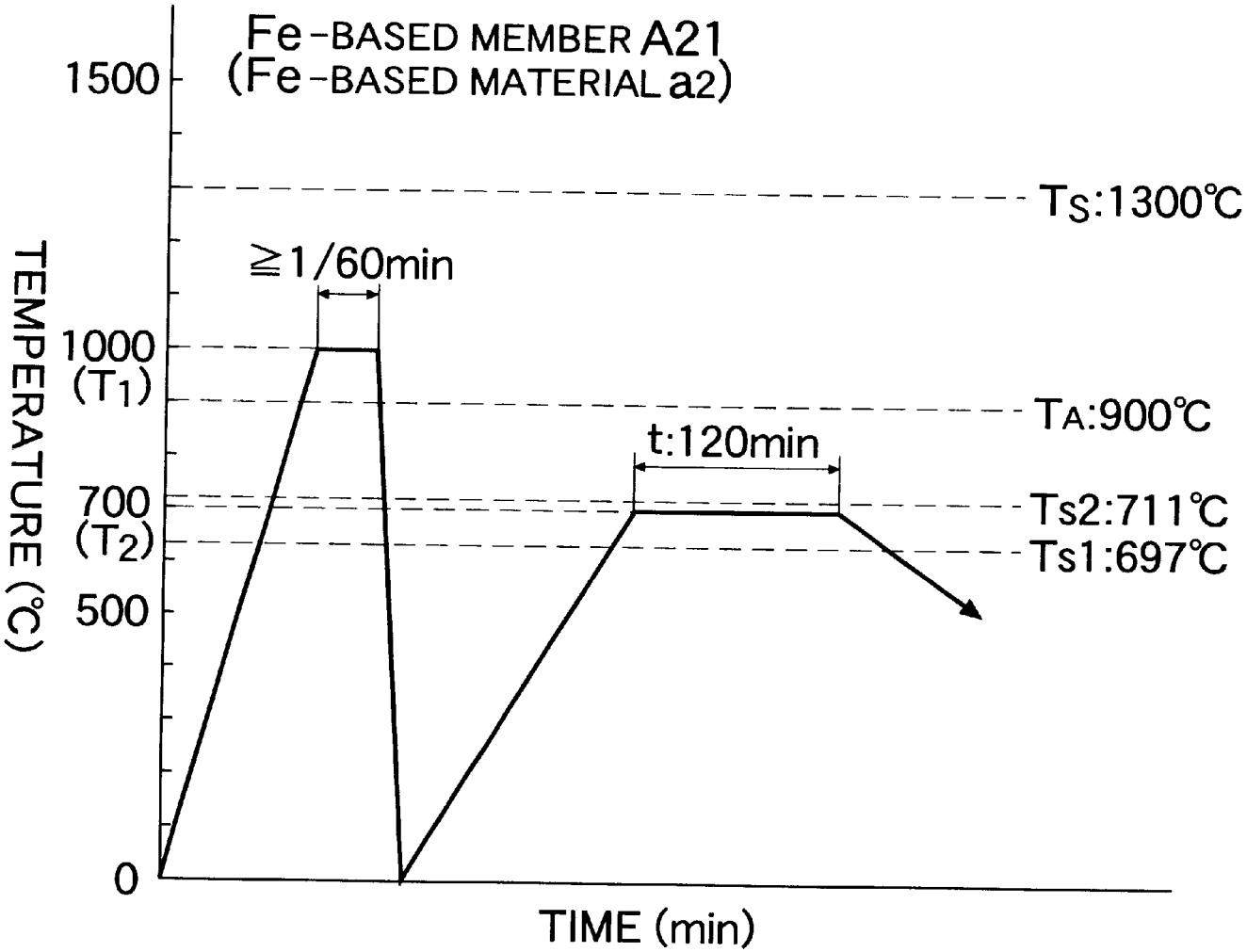
FIG. 13 is a diagram of heat cycle for producing an Fe-based member A21.

Both the Fe-based materials a1 and a2 were used and subjected to the treatments at the first and second steps under conditions shown in Table 6 and FIGS. 12 and 13 to produce an Fe-based member A13 corresponding to the Fe-based material a1 and an Fe-based member A21 corresponding to the Fe-based material a2. The Fe-based material a1 was subjected to a hot stretching treatment under conditions of a temperature of 1,100° C. and a draft rate of about 90% and then subjected to the treatments at the first and second steps under the same conditions as for the Fe-based member A13, thereby producing an Fe-based member A14.

Figure 14:
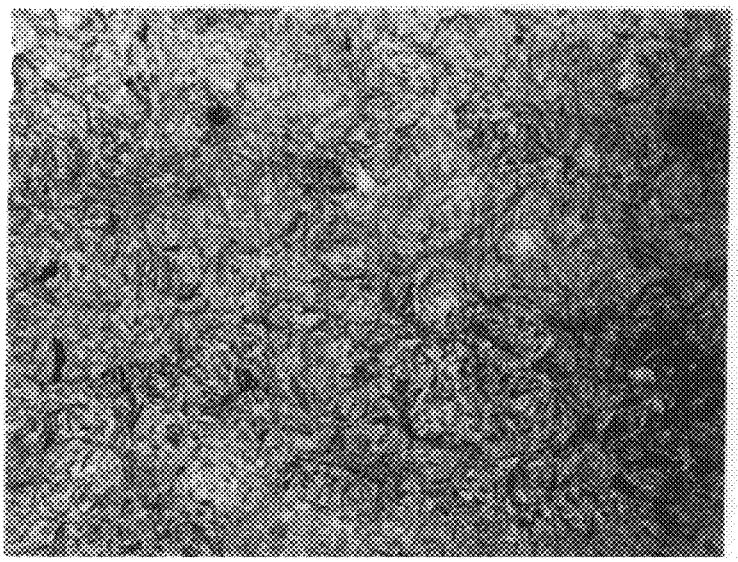
FIG. 14 is a photomicrograph showing a primary thermally treated structure of an Fe-based material a1.
Figure 15:
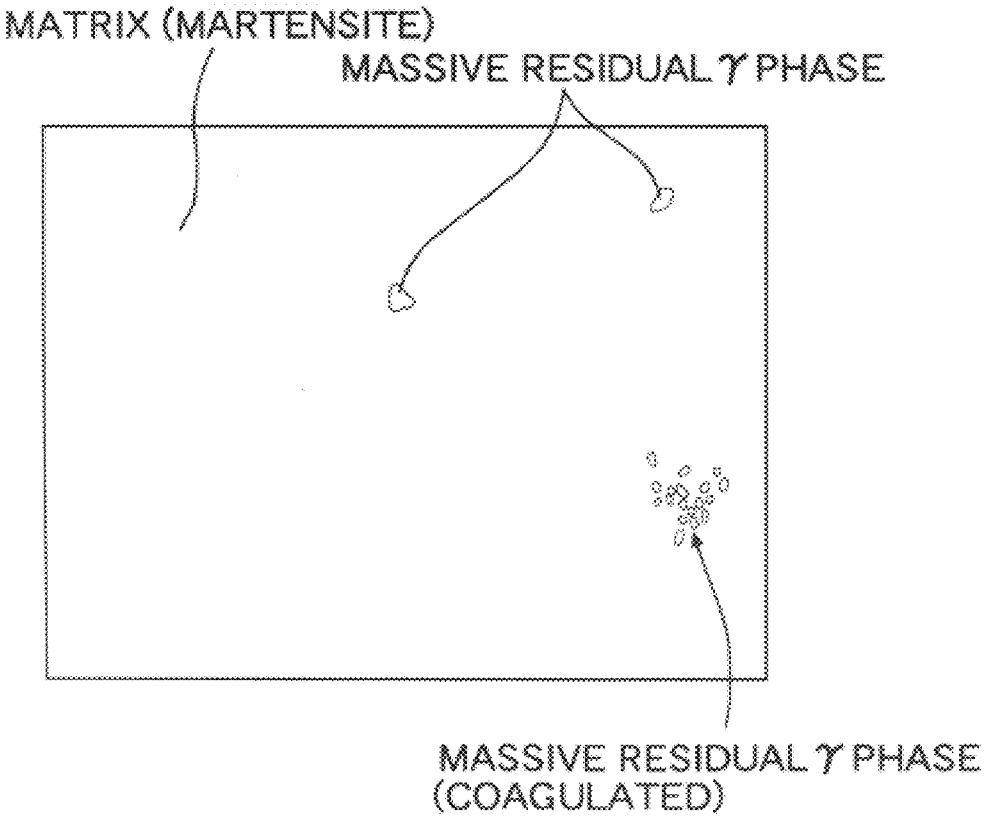
FIG. 15 is a schematic tracing of FIG. 14.

FIG. 14 is a photomicrograph showing a primary thermally treated structure of the Fe-based material a1 resulting from the first step, and FIG. 15 is a schematic tracing of the FIG. 14. The primary thermally treated structure is comprised of a matrix comprising martensite, a large number of massive residual γ phases and the like.

Figure 16:
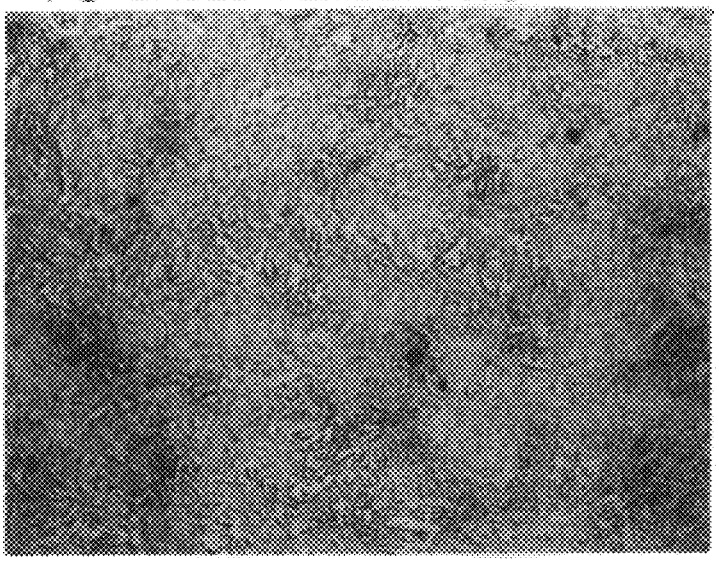
FIG. 16 is a photomicrograph showing a secondary thermally treated structure of an Fe-based member A13.
Figure 17:
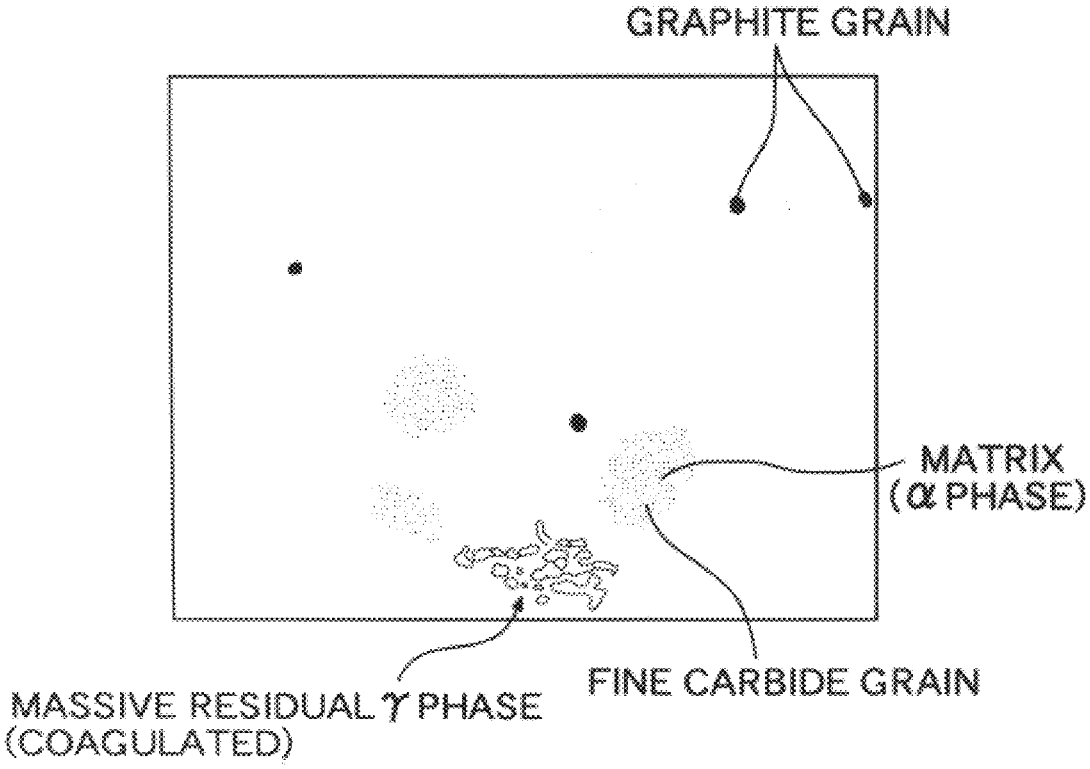
FIG. 17 is a schematic tracing of FIG. 16.

FIG. 16 is a photomicrograph showing a secondary thermally treated structure of the Fe-based member A13, and FIG. 17 is a schematic tracing of FIG. 16. The secondary thermally treated structure is comprised of a matrix comprising an α phase, a large number of fine carbide granules (mainly, $Fe_3C$), a large number of graphite grains, a large number of massive precipitated γ phases and the like.

In the secondary thermally treated structure, the fine carbide granules, which are fine carbide, contribute to an enhancement in Young's modulus of the Fe-based member A13. In this case, it is desirable that the average number of the fine carbide granules per 1 $\mu m^2$ is equal to or more than 1.05. The method for determining this amount of the fine carbide granules is the same as in EXAMPLE I. When fine fiber-shaped carbide phases are included in the secondary thermally treated structure, they also contribute to the enhancement in Young's modulus of the Fe-based member A13.

The precipitated γ phases confine impurities therein to contribute to an enhancement in toughness of the Fe-based member A13. For this purpose, it is desirable that the content d of the precipitated γ phases is equal to or more than 0.25% by weight ($d \geqq 0.25\%$ by weight). The method for determining the content d of the precipitated γ phases is the same as in EXAMPLE I.

For the Fe-based members A13, A14 and A21, the average number of the fine carbide granules per 1 $\mu m^2$ and the content d of the precipitated γ phases were determined by the above-described method, and the tensile test was carried out to determine the tensile strength and the Young's modulus. Further, the Charpy impact test was carried out to determine a Charpy impact value, thereby providing results shown in Table 7.

TABLE 7

| | average number of fine carbide granules per 1 $\mu m^2$ | content d of precipitated γ phases (% by weight) | tensile strength (MPa) | Young's modulus (GPa) | Charpy impact value ($J/cm^2$) |
|---|---|---|---|---|---|
| Fe-based member A13 | 1.05 | 1.76 | 873 | 244 | 31.1 |
| Fe-based member A21 | 0.23 | 1.75 | 665 | 231 | 3.8 |
| Fe-based member A14 | 1.05 | 1.76 | 860 | 245 | 60.2 |

It can be seen Table 7 that the Fe-based member A13 according the example of the present invention has a Young's modulus increased about 1.1 times, a Charpy impact value increased about 8.2 times, and a strength increased about 1.3. times as high as those of the Fe-based member A21 according to a comparative example. Therefore, the Fe-based member A13 has a higher Young's modulus and a higher strength. The Fe-based member A14 according to the example of the present invention produced using the Fe-based material a1 resulting from the stretching treatment has a Charpy impact value increased about 2 times as high as that of the Fe-based member A13.

Figure 18:
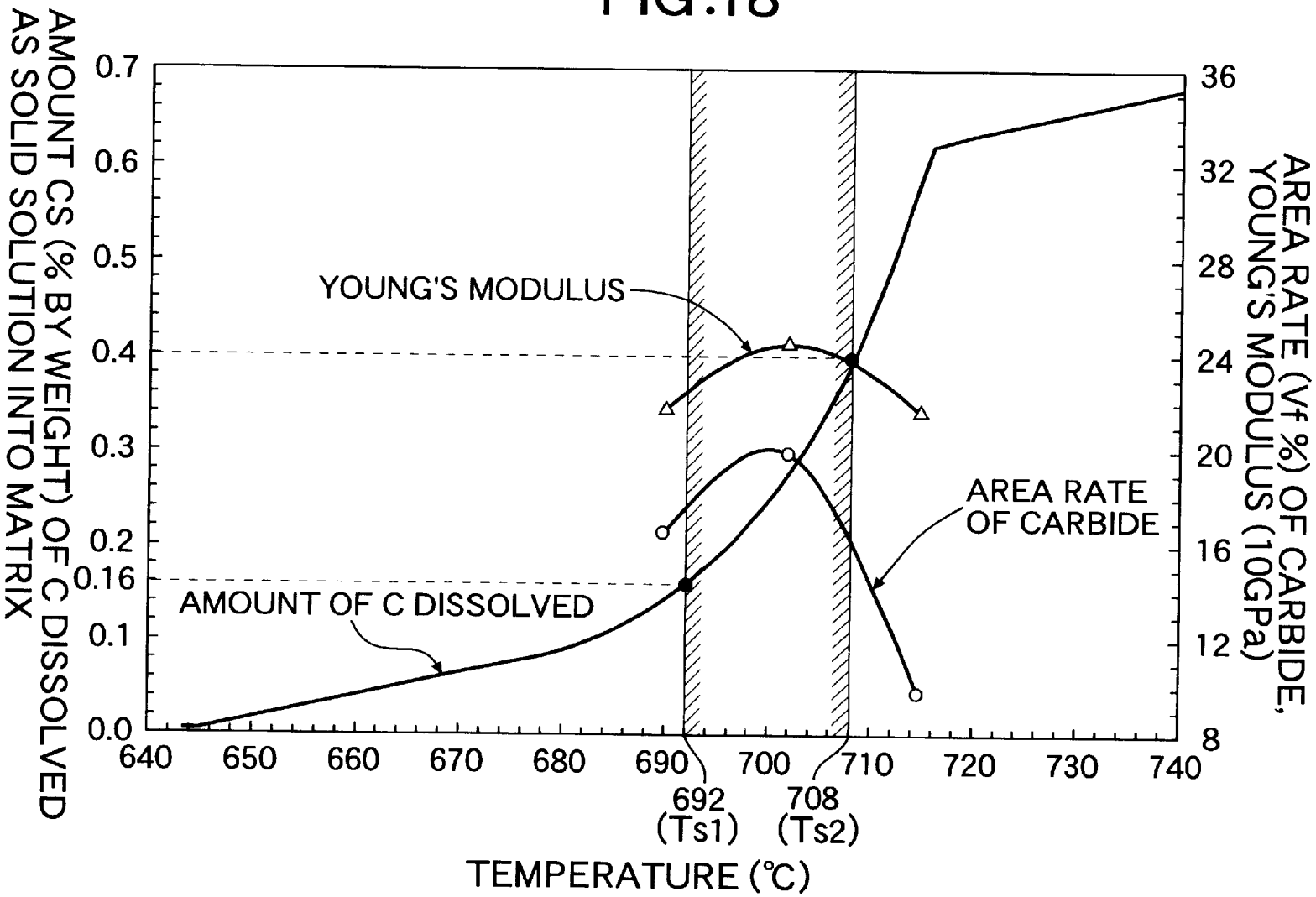
FIG. 18 is a graph showing the relationship between the temperature and the amount CS of carbon dissolved as a solid solution into a matrix of the Fe-base material as well as the Young's modulus and the area rate of carbide in the Fe-based member.

FIG. 18 shows the relationship between the temperature and the amount of carbon dissolved as a solid solution into the matrix in the Fe-based material a1 as well as the Young's modulus and the carbide area rate in the Fe-based member A13. As apparent from FIG. 18, it can be seen that if the heating temperature $T_2$ at the second step is set between the temperature $T_S1$ when the amount CS of carbon dissolved as the solid solution in the matrix is 0.16% by weight and the temperature $T_S2$. when the amount CS is 0.40% by weight, the amount of carbide precipitated in the Fe-based member A13 is large, whereby the Young's modulus of the member A13 is enhanced largely.

Figure 19:
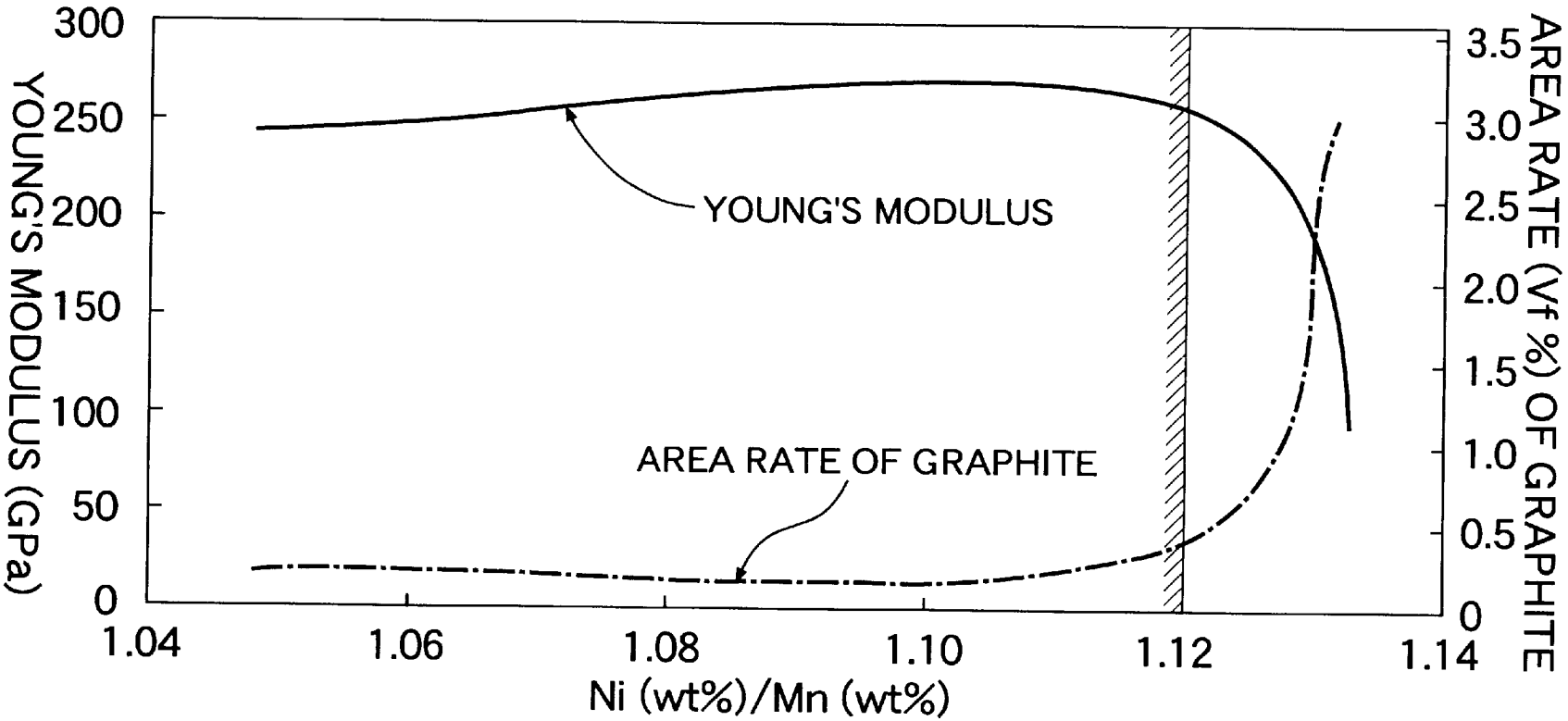
FIG. 19 is a graph showing the relationship between the Ni (% by weight)/Mn (% by weight) and the Young's modulus as well as the area rate of graphite in the Fe-based member.

FIG. 19 shows the relationship between the ratio Ni (% by weight)/Mn (% by weight) of the nickel (Ni) and manganese (Mn) contents and the Young's modulus as well as the graphite area rate for the Fe-based member. As apparent from FIG. 19, when the ratio Ni (% by weight)/Mn (% by weight) is equal to or smaller than 1.12, the graphite area rate is lower and the Young's modulus is higher, but when the ratio Ni (% by weight)/Mn (% by weight) is larger than 1.12, the relationship between the graphite area rate and the Young's modulus is reversed.

Figure 20:
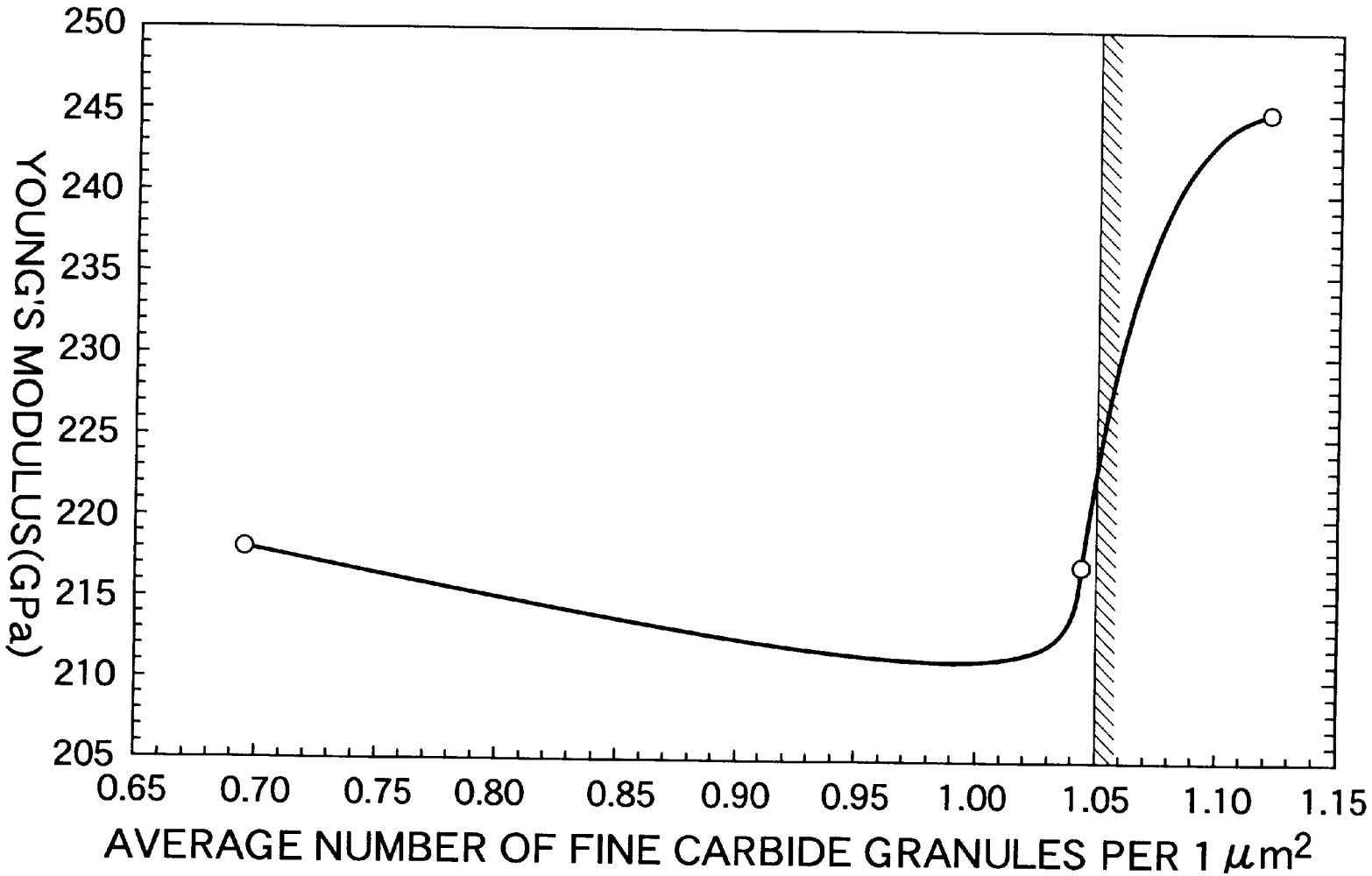
FIG. 20 is a graph showing the relationship between the average number of fine carbide granules per 1 $\mu m^2$ and the Young's modulus in the Fe-based member.

FIG. 20 shows the relationship between the average number of the fine carbide granules per 1 $\mu m^2$ and the Young's modulus for the Fe-based member. It can be seen from FIG. 20 that if the average number is set at 1.05 or more, the Young's modulus of the Fe-based member is enhanced remarkably.

EXAMPLE III

Table 8 shows compositions of Fe-based materials a5 and a6. The Fe-based materials a5 and a6 were produced in a casting manner by a die casting process.

TABLE 8

| | Chemical constituent (% by weight) | | | | | | | |
|---|---|---|---|---|---|---|---|---|
| | C | Si | Mn | P | S | Ni | Ti | Fe |
| Fe-based material a5 | 0.83 | 0.28 | 1.34 | 0.006 | 0.004 | 1.11 | 1.14 | Balance |
| Fe-based material a6 | 0.86 | 0.2 | 1.24 | 0.007 | 0.005 | 1.1 | — | Balance |

The $A_3$ temperature $T_A$ of the Fe-based material a5; the Acm temperature $T_A$ of the Fe-based material a6; the temperature $T_S1$ when the C solid solution amount CS=0.16% by weight and the temperature $T_S2$ when CS=0.40% by weight are as shown in Table 9.

TABLE 9

| | First step | | Second step | | |
|---|---|---|---|---|---|
| | Heating temperature (° C.) | Cooling rate (° C./min) | Heating temperature (° C.) | Heating time (min) | Cooling type |
| Fe-based member A15 | $T_1$: 790 ($T_A3$: 724) | CA: 1000 | $T_2$: 698 Te1: 686.5 Te2: 708 | t: 60 | air-cooling |
| Fe-based member A21 | $T_1$: 900 ($T_A$: 805) | CA: 1300 | $T_2$: 700 $T_S1$: 689.5 $T_S2$: 708.5 | t: 60 | air-cooling |

Figure 21:
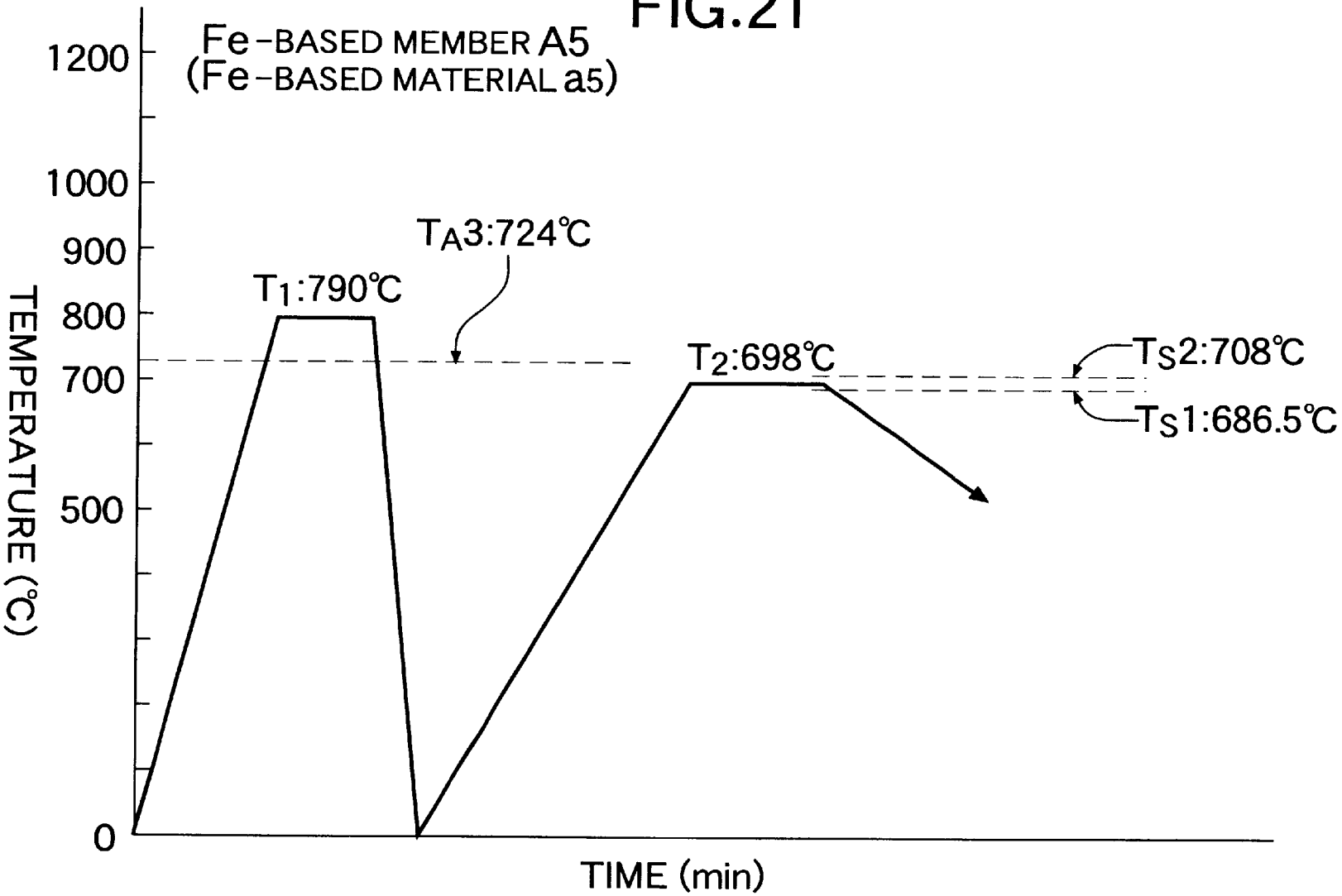
FIG. 21 is a diagram of a heat cycle for producing an Fe-based member A5.
Figure 22:
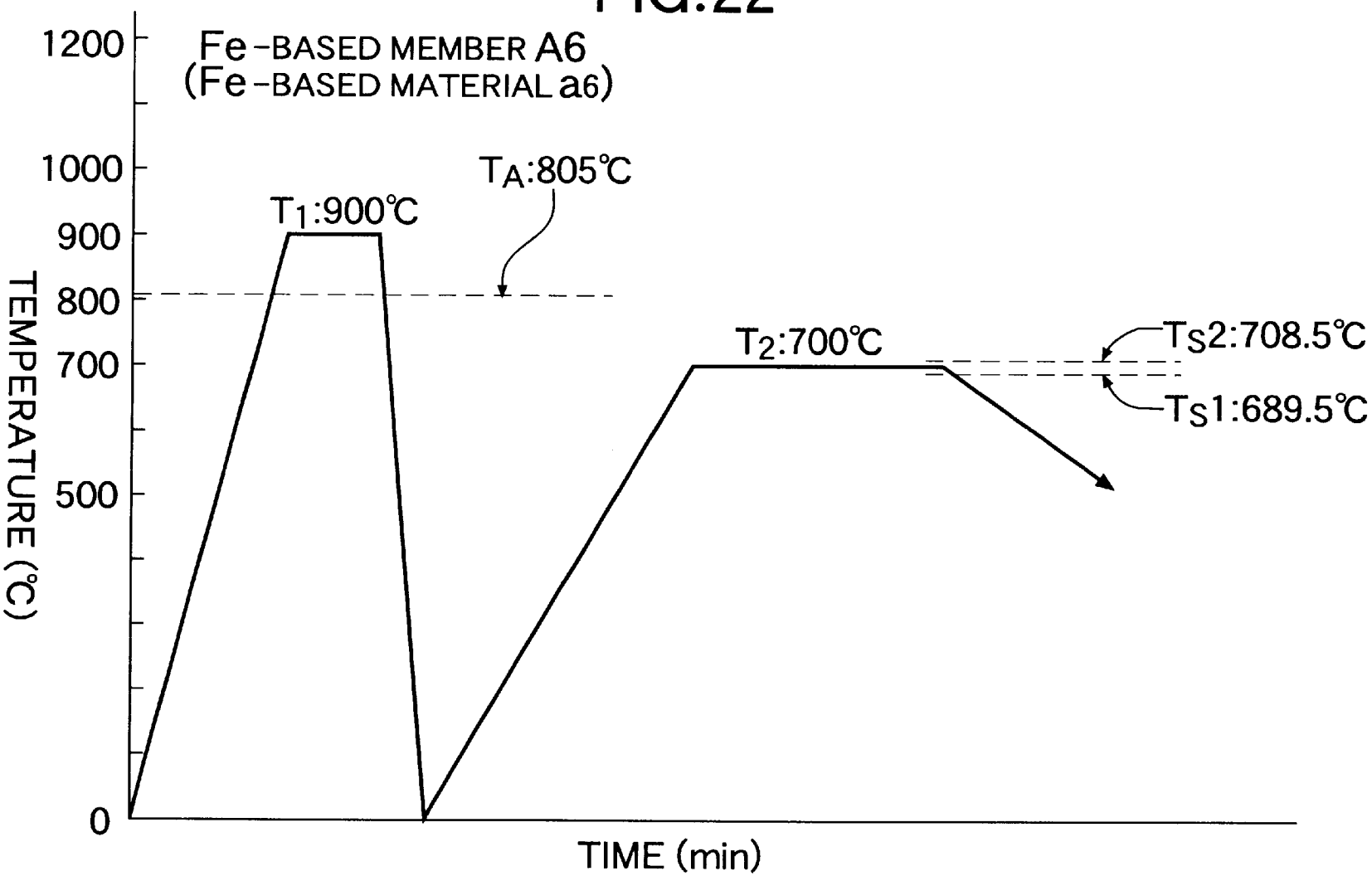
FIG. 22 is a diagram of a heat cycle for producing an Fe-based member A6.

Both the Fe-based materials a5 and a6 were used and subjected to the treatments at the first and second steps under conditions shown in Table 9 and FIGS. 21 and 22 to produce an Fe-based member A5 corresponding to the Fe-based material a5 and an Fe-based member A6 corresponding to the Fe-based material a6. The Fe-based material a5 resulting from the treatment at the first step has a primary thermally treated structure comprised of a matrix comprising martensite, a large number of massive residual γ phases and the like. The Fe-based member A5 has a secondary thermally treated structure comprised of a matrix comprising a hypoeutectic structure, a large number of fine carbide granules (mainly, $Fe_3C$), a large number of graphite grains, a large number of massive precipitated γ phases and the like.

In the secondary thermally treated structure, the fine carbide granules, which are fine carbide, contribute to an enhancement in Young's modulus of the Fe-based member A5. In this case, it is desirable that the average number of the fine carbide granules per 1 $\mu m^2$ is equal to or more than 1.05 (see FIG. 20). The method for determining the amount of the fine carbide granules is the same as in EXAMPLE I. When fine short fiber-shaped carbide are included in the secondary thermally treated structure, they also contribute to the enhancement in Young's modulus of the Fe-based member A5.

The precipitated γ phases confine impurities therein to contribute to an enhancement in toughness of the Fe-based member. For this purpose, it is desirable that the content d of the precipitated γ phases is equal to or more than 0.25% by weight (d≧0.25% by weight). The method for determining the content d of the precipitated γ phases is the same as in EXAMPLE I.

For the Fe-based members A5 and A6, the average number of the fine carbide granules per 1 $\mu m^2$ and the content d of the precipitated γ phases were determined by the above-described method, and the tensile test was carried out to determine the tensile strength and the Young's modulus. Further, the Charpy impact test was carried out to determine a Charpy impact value, thereby providing results shown in Table 10.

TABLE 10

| | average number of fine carbide granules per 1 $\mu m^2$ | content d of precipitated γ phases (% by weight) | tensile strength (MPa) | Young's modulus (GPa) | Charpy impact Value (10 R) ($J/cm^2$) |
|---|---|---|---|---|---|
| Fe-based member A5 | 1.077 | 1.9 | 773 | 253 | 61 (U) |
| Fe-based member A6 | 1.141 | 1.9 | 820 | 246 | 51 (U) |

It can be seen Table 10 that the Fe-based member A5 according the example of the present invention is slightly inferior in tensile strength to the Fe-based member A6 according to the comparative example, but superior in Young's modulus and Charpy impact value to the Fe-based member A6, and hence, has a higher Young's modulus and a higher toughness.

Then, the Fe-based members A5 and A6 were subjected to a bending test as follows: First, the Fe-based members A5 and A6 were bent through 90° using a V block. No defect was produced in the Fe-based member A5, but cracks were produced in the Fe-based member A6. Then, the Fe-based member A5 bent through 90° was bent so that opposite-side pieces may be overlapped with each other, i.e., was bent through 180°. The generation of cracks or the like was not observed in the Fe-based member A5. From this, it was ascertained that an Fe-based member A5 having a good cold workability can be produced according to the example of the present invention.

Figure 23:
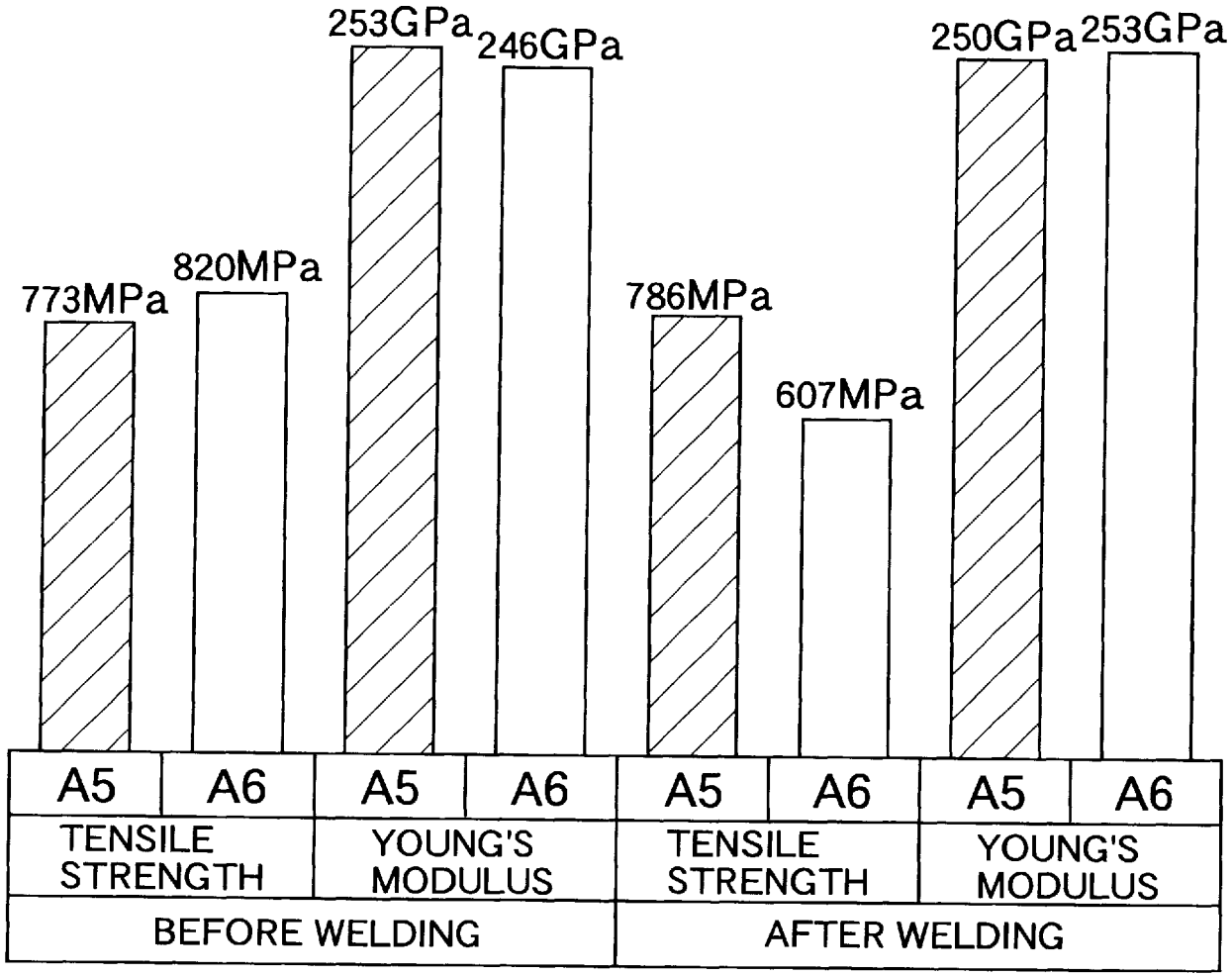
FIG. 23 is a graph showing the tensile strength and the Young's modulus before and after welding for the Fe-based members A5 and A6.

Then, the tensile strength and the Young's modulus of the Fe-based members A5 and A6 after being subjected to a welding, were considered. In the welding, a procedure was employed which comprises cutting rod-shaped Fe-based members A5 and A6 having a diameter of 3 mm at a point of one half in the lengthwise direction; polishing each of the sections of both halves into a smooth surface; and then bringing the sections of both the halves into abutment against each other to conduct a projection welding. FIG. 23 shows the tensile strength and the Young's modulus of the Fe-based members A5 and A6 before and after the welding. In FIG. 23, A5 and A6 correspond to the Fe-based members A5 and A6, respectively. As apparent from FIG. 23, it can be seen that in the case of the Fe-member A5, the variations in tensile strength and Young's modulus between before and after the welding are not so large, but in the case of the Fe-based member A6, the tensile strength is decreased large after the welding. This is mainly due to that the Fe-based member A6 does not contain titanium (Ti).

Figure 24:
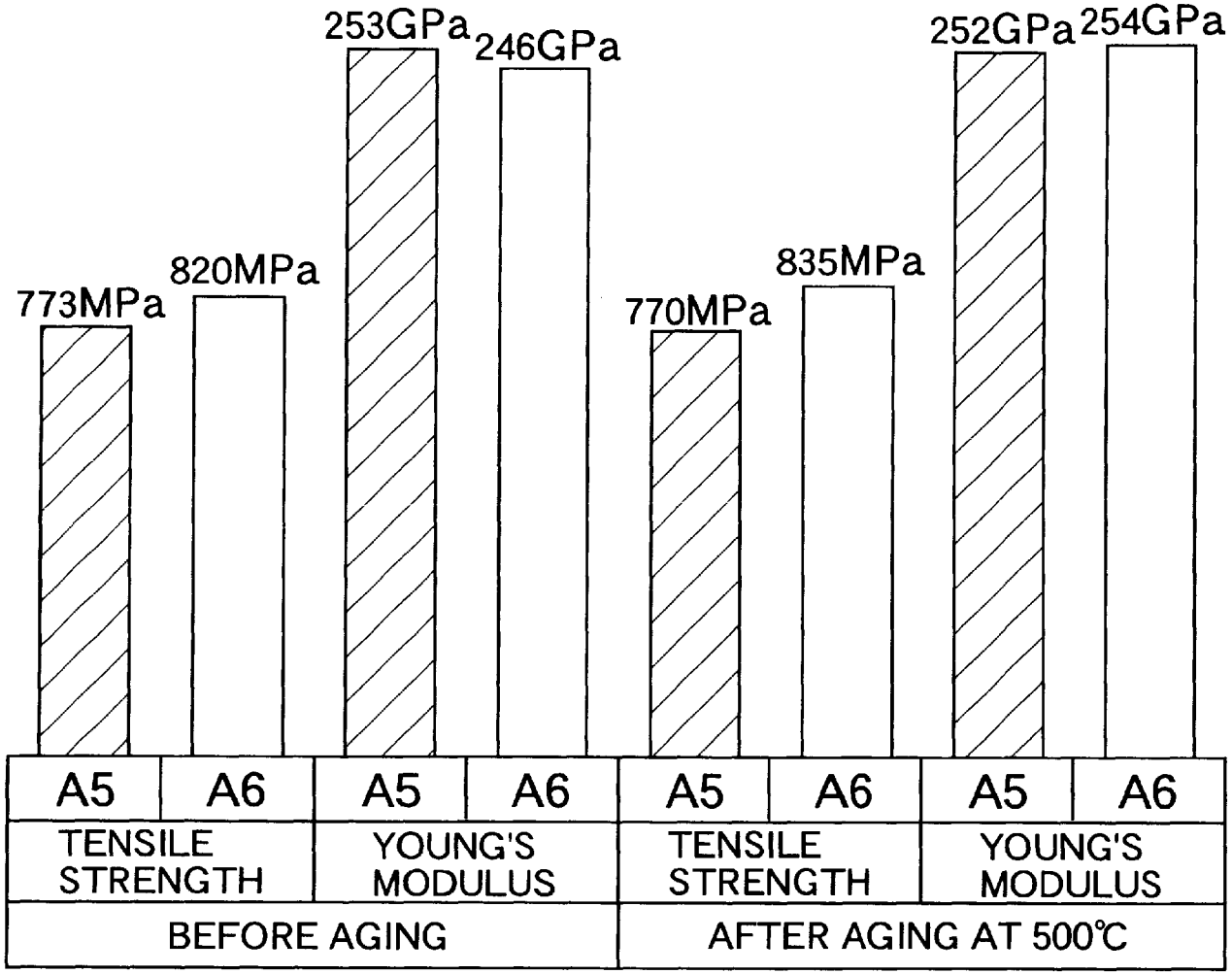
FIG. 24 is a graph showing the tensile strength and the Young's modulus before and after aging at 500° C. for the Fe-based members A5 and A6.
Figure 25:
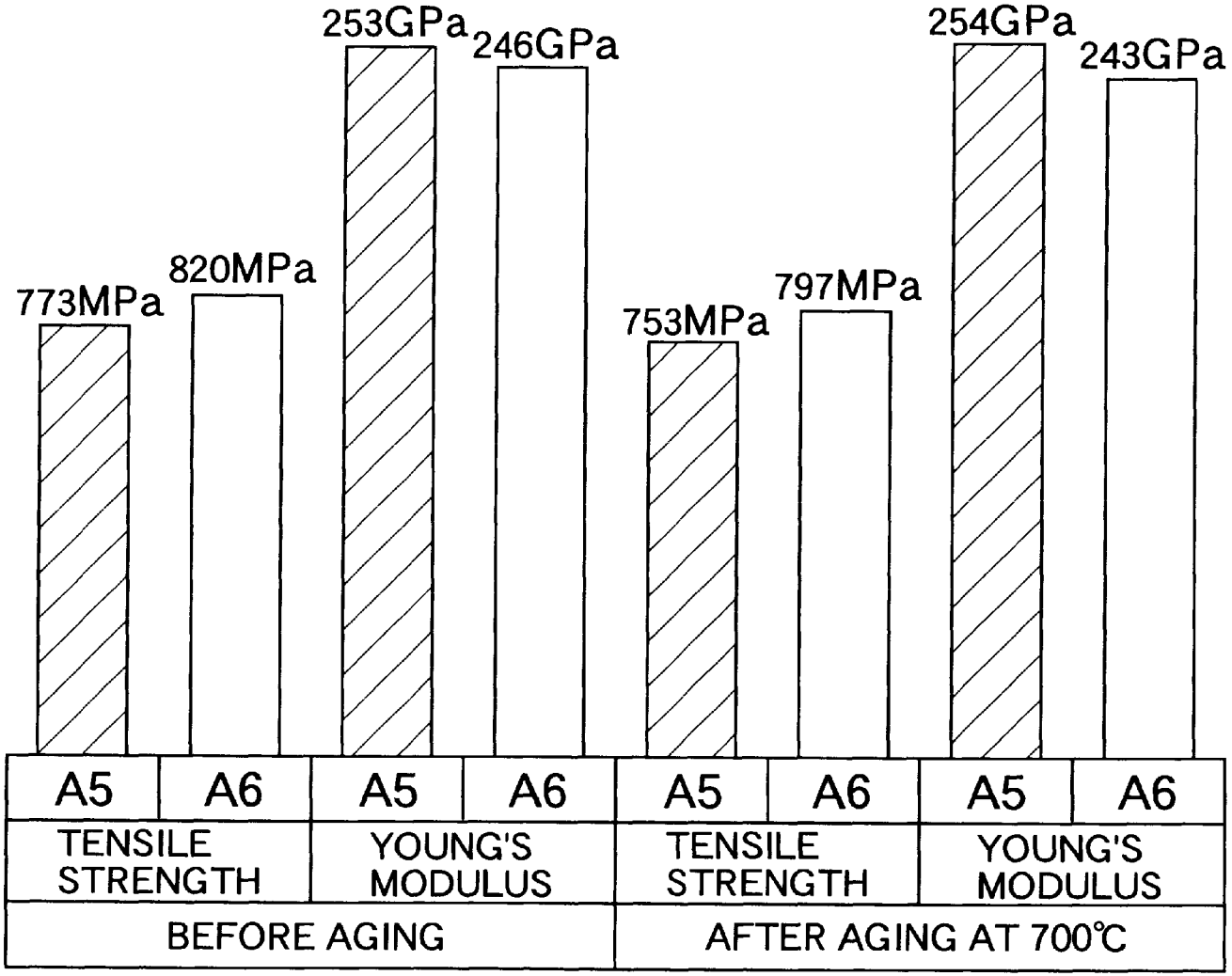
FIG. 25 is a graph showing the tensile strength and the Young's modulus before and after aging at 700° C. for the Fe-based members A5 and A6.

Then, the tensile strength and Young's modulus of the Fe-based members A5 and A6 after artificial aging were considered. FIGS. 24 and 25 show the tensile strength and Young's modulus of the Fe-based members A5 and A6 before and after the aging at 500° C. and before and after the aging at 700° C. In FIGS. 24 and 25, A5 and A6 correspond to the Fe-based members A5 and A6, respectively. As apparent from FIG. 24, it can be seen that the variations in tensile strength and Young's modulus of the Fe-based member A5 between before and after the aging at 500° C. are smaller than those of the Fe-based member A6. On the other hand, it can be seen from FIG. 25 that the variation in Young's modulus of the Fe-based member A6 between before and after the aging at 700° C. is smaller than that of the Fe-based member A5. It can be seen from FIGS. 24 and 25 that the Young's modulus of the Fe-based member A5 is little varied with the passage of time.

What is claimed is:

1. A heat treatment process for producing an Fe-based member, consisting essentially of:

a first step of subjecting an Fe-based material comprising
0.6% by weight≦carbon (C)≦1.9% by weight
silicon (Si)<2.2% by weight
0.9% by weight≦manganese (Mn)≦1.7% by weight
0.5% by weight≦nickel (Ni)≦1.5% by weight and
the balance of iron (Fe) including inevitable impurities,
to a thermal treatment at a heating temperature $T_1$ set in a range of $T_S<T_1<T_L$, wherein $T_S$ represents a solidus temperature for the Fe-based material and $T_L$ represents a liquidus temperature, and under a cooling condition set at a quenching level, and a second step of subjecting the resulting Fe-based material to a thermal treatment at a heating temperature $T_2$ set in a range of Te1<T2<Te2, wherein Te1 represents a eutectic transformation starting temperature, and Te2 represents a eutectic transformation finishing temperature, and for a heating time t set in a range of 60 min≦t≦180 min.

2. A heat treatment process consisting essentially of:

a first step of subjecting an Fe-based material comprising
0.6% by weight≦carbon (C)≦1.9% by weight
silicon (Si)<2.2% by weight
0.9% by weight≦manganese (Mn)≦1.7% by weight
0.5% by weight≦nickel (Ni)≦1.5% by weight and
the balance of iron (Fe) including inevitable impurities,
to a treatment at a heating temperature $T_1$ set at $T_1>T_L$, wherein $T_L$ represents a liquidus temperature of the Fe-based material and under a cooling condition set at a quenching level, and a second step of subjecting the resulting Fe-based material to a thermal treatment at a heating temperature $T_2$ set in a range of $Te1<T_2<Te2$, wherein Te1 represents a eutectic transformation starting temperature of said Fe-based material, and Te2 represents a eutectic transformation finishing temperature of said Fe-based material, and for a heating time t set in a range of 60 min≦t≦180 min.

3. A heat treatment process consisting essentially of:

a first step of subjecting an Fe-based material comprising
0.6% by weight≦carbon (C)≦1.9% by weight
silicon (Si)<2.2% by weight
0.9% by weight≦manganese (Mn)≦1.7% by weight
0.5% by weight≦nickel (Ni)≦1.5% by weight and
the balance of iron (Fe) including inevitable impurities,
to a thermal treatment at a heating temperature $T_1$ set in a range of $T_A<T_1<T_S$, wherein $T_A$ represents an Acm temperature for the Fe-based material, and $T_S$ represents a solidus temperature, and under a cooling condition set at a quenching level, and a second step of subjecting the resulting Fe-based material to a thermal treatment at a heating temperature $T_2$ set in a range of $Te1<T_2<Te2$, wherein Te1 represents a eutectic transformation starting temperature and Te2 represents a eutectic transformation finishing temperature, and for a heating time t set in a range of 60 min≦t≦180 min.

4. A heat treatment process according to one of claim 1, 2, or 3, wherein fine carbide granules are precipitated at said second step, the average number of said fine carbide granules per 1 $\mu m^2$ being equal to or more than 1.05.

5. A heat treatment process consisting essentially of:

a first step of subjecting an Fe-based material comprising
0.6% by weight≦carbon (C)≦1.9% by weight
silicon (Si)<2.2% by weight
0.9% by weight≦manganese (Mn)≦1.7% by weight
0.5% by weight≦nickel (Ni)≦1.5% by weight
Ni (% by weight)/Mn(% by weight)≦1.12 and
the balance of iron (Fe) including inevitable impurities, to a thermal treatment at a heating temperature $T_1$ set at $T_1 \geqq T_A$, wherein $T_A$ represents an Acm temperature for the Fe-based material, and under a cooling condition set at a quenching level, and a second step of subjecting the resulting Fe-based material to a thermal treatment at a heating temperature $T_2$ set in a range of $T_S1 \leqq T_2 \leqq T_S2$, wherein $T_S1$ represents a temperature when the amount of carbon solid solution in a matrix of said Fe-based material is 0.16% by weight, and $T_S2$ represents a temperature when the amount of said carbon solid solution is 0.40% by weight.

6. A heat treatment process according to claim 5, wherein fine carbide granules are precipitated at said second step, the average number of said fine carbide granules per 1 $\mu m^2$ being equal to or more than 1.05.

7. A heat treatment process according to claim 5 or 6, wherein massive γ phases are precipitated at said second step, the content d of said massive γ phases being equal to or more than 0.25% by weight.

8. A heat treatment process consisting essentially of:

a first step of preparing an Fe-based material comprising
0.6% by weight≦carbon (C)≦1.0% by weight
silicon (Si)<2.2% by weight
0.9% by weight≦manganese (Mn)≦1.7% by weight
0.5% by weight≦nickel (Ni)≦1.5% by weight
Ni(% by weight)/Mn(% by weight)≦1.12
0.3% by weight≦AE≦1.5% by weight and
the balance of iron (Fe) including inevitable impurities, wherein AE is at least one alloy element selected from the group consisting of Ti, V, Nb, W and Mo, and subjecting said Fe-based material to a thermal treatment at a heating temperature $T_1$ set at $T_1 \geqq T_A3$, wherein $T_A3$ represents the $A_3$ temperature of said Fe-based material and under a cooling condition set at a quenching level, and a second step of subjecting the resulting Fe-based material to a thermal treatment at a heating temperature $T_2$ set in a range of $T_S1 \leqq T_2 \leqq T_S2$, wherein $T_S1$ represents a temperature when the amount of carbon solid solution in a matrix of said Fe-based material is 0.16% by weight, and $T_S2$ represents a temperature when the amount of carbon solid solution is 0.40% by weight.

9. A heat treatment process according to claim 8, wherein said fine carbide granules and massive γ phase are precipitated at said second step, the average number of said fine carbide granules per 1 $\mu m^2$ being equal to or more than 1.05, and the content d of said massive γ phases being equal to or more than 0.25% by weight.

* * * * *